US011164518B2

(12) United States Patent
Na et al.

(10) Patent No.: US 11,164,518 B2
(45) Date of Patent: Nov. 2, 2021

(54) DISPLAY DEVICE

(71) Applicant: Samsung Display Co., Ltd., Yongin-si (KR)

(72) Inventors: Ji Su Na, Yongin-si (KR); Min Woo Byun, Seongnam-si (KR); Seung Kyu Lee, Ansan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 20 days.

(21) Appl. No.: 16/443,172

(22) Filed: Jun. 17, 2019

(65) Prior Publication Data

US 2019/0385523 A1 Dec. 19, 2019

(30) Foreign Application Priority Data

May 28, 2019 (KR) ..... 10-2019-0062730

(51) Int. Cl.

| | |
|---|---|
| ***G09G 3/32*** | (2016.01) |
| ***G09G 3/3233*** | (2016.01) |
| ***G09G 3/3266*** | (2016.01) |
| ***G09G 3/3291*** | (2016.01) |

(52) U.S. Cl.

CPC ..... *G09G 3/3233* (2013.01); *G09G 3/3266* (2013.01); *G09G 3/3291* (2013.01); *G09G 2300/0426* (2013.01); *G09G 2300/0809* (2013.01)

(58) Field of Classification Search

CPC .. G09G 3/3266; G09G 3/3291; G09G 3/3233; G09G 2300/0861; G09G 2300/0809; G09G 2300/0866; G09G 2320/0233; G09G 2310/08; G09G 2300/0819; G09G 2300/0426; G09G 2300/0842

See application file for complete search history.

(56) References Cited

U.S. PATENT DOCUMENTS

| | | | | |
|---|---|---|---|---|
| 2003/0210219 | A1* | 11/2003 | Osame | G09G 3/30 345/92 |
| 2011/0063262 | A1* | 3/2011 | Umezaki | H01L 27/1225 345/204 |
| 2011/0074750 | A1* | 3/2011 | Leon | G09G 3/30 345/207 |
| 2015/0049126 | A1* | 2/2015 | Jung | G09G 3/3233 345/690 |
| 2017/0092198 | A1* | 3/2017 | Ryu | G09G 3/3275 |
| 2017/0263187 | A1* | 9/2017 | Zhu | G09G 3/3233 |

* cited by examiner

*Primary Examiner* — Towfiq Elahi

(74) *Attorney, Agent, or Firm* — H.C. Park & Associates, PLC

(57) ABSTRACT

A display device includes a light emitting element. A first transistor transmits a driving current to the light emitting element. A second transistor is connected to a first electrode of the first transistor to transmit a data signal. A third transistor has a first electrode connected to a second electrode of the first transistor. An auxiliary transistor is connected between a second electrode of the third transistor and a gate electrode of the first transistor to transmit the data signal to the gate electrode of the first transistor. Each of the first transistor, the second transistor and the auxiliary transistor is a first-type transistor, and the third transistor is a second-type transistor different from the first-type transistor.

22 Claims, 11 Drawing Sheets

DISPLAY DEVICE

CROSS REFERENCE TO RELATED APPLICATION

This application claims priority from and the benefit of Korean Patent Application No. 10-2018-0070129, filed on Jun. 19, 2018 and Korean Patent Application No. 10-2019-0062730, filed on May 28, 2019, which are hereby incorporated by reference for all purposes as if fully set forth herein.

BACKGROUND

Field

Exemplary embodiments of the invention relate generally to a display device and, more specifically, to a light emitting display having pixels, each including both P-channel metal-oxide-semiconductor field-effect transistors (PMOS transistors) and N-channel metal-oxide-semiconductor field-effect transistors (NMOS) transistors.

Description of the Background

With the development of multimedia, display devices are becoming increasingly important. Accordingly, various types of display devices such as liquid crystal display devices and display devices including self-light emitting elements are being used. Among them, a display device including a self-light emitting element displays an image using the self-light emitting element. The display device including the self-light emitting element includes a plurality of transistors that provide a driving current to the self-light emitting element.

P-channel metal-oxide-semiconductor field-effect transistors (PMOS transistors) are widely used as transistors of the display device. However, research is being conducted to use N-channel metal-oxide-semiconductor field-effect transistors (NMOS transistors) or use both PMOS and NMOS transistors.

A PMOS transistor and an NMOS transistor have different characteristics from each other. They are also different in the direction (positive or negative) of a kickback voltage according to parasitic capacitance. Therefore, if some or all of the PMOS transistors are changed to NMOS transistors, the kickback voltage characteristic may be changed.

The above information disclosed in this Background section is only for understanding of the background of the inventive concepts, and, therefore, it may contain information that does not constitute prior art.

SUMMARY

Devices constructed according to exemplary embodiments of the invention are capable of providing a display device which prevents a gate voltage of a transistor from being dropped by a kickback.

Additional features of the inventive concepts will be set forth in the description which follows, and in part will be apparent from the description, or may be learned by practice of the inventive concepts.

According to exemplary embodiments, a display device includes a light emitting element. A first transistor transmits a driving current to the light emitting element. A second transistor is connected to a first electrode of the first transistor to transmit a data signal. A third transistor has a first electrode connected to a second electrode of the first transistor. An auxiliary transistor is connected between a second electrode of the third transistor and a gate electrode of the first transistor to transmit the data signal to the gate electrode of the first transistor. Each of the first transistor, the second transistor and the auxiliary transistor is a first-type transistor, and the third transistor is a second-type transistor different from the first-type transistor.

The first-type transistor may be a P-channel metal-oxide-semiconductor field-effect transistor (PMOS transistor), and the second-type transistor may be an N-channel metal-oxide-semiconductor field-effect transistor (NMOS transistor).

The first-type transistor may be a top-gate transistor in which a gate electrode is disposed above a semiconductor layer, and the second-type transistor may be a bottom-gate transistor in which a gate electrode is disposed below a semiconductor layer.

The first-type transistor may include an oxide semiconductor, and the second-type transistor may include polycrystalline silicon.

The display device may further include a fourth transistor which is connected between the gate electrode of the first transistor and an initialization voltage line. Here, the fourth transistor may be the second-type transistor.

The display device may further include a fifth transistor which is connected between the first electrode of the first transistor and a first power supply voltage wiring, a sixth transistor which is connected between the second electrode of the first transistor and a first electrode of the light emitting element, a seventh transistor which is connected between the first electrode of the light emitting element and the initialization voltage line, and a storage capacitor which is formed between the first electrode of the first transistor and the first power supply voltage wiring. Here, each of the fifth, sixth and seventh transistors may be the first-type transistor.

The display device may further include a first scan line and a second scan line. Here, a gate electrode of the second transistor may be connected to the first scan line, a gate electrode of the auxiliary transistor may be connected to the first scan line, and a gate electrode of the third transistor may be connected to the second scan line.

The second transistor and the auxiliary transistor may be turned on in a first period in response to a first scan signal provided through the first scan line, and the third transistor may be turned on in the first period in response to a second scan signal provided through the second scan line.

The second transistor and the auxiliary transistor may be turned on in a first period in response to a first scan signal provided through the first scan line, the third transistor may be turned on in a second period in response to a second scan signal provided through the second scan line, and the second period may be greater than the first period and comprises the first period.

The second scan signal may have a turn-on voltage level in the second period, and the second period of the second scan signal may partially overlap the second period of the second scan signal of a previous time point.

In plan view, the second scan line may be disposed in a first direction based on the first transistor and may extend in a second direction perpendicular to the first direction, the first scan line may be disposed in the first direction based on the second scan line and may be parallel to the second scan line, the third transistor may partially overlap the second scan line, and the auxiliary transistor partially may overlap the first scan line.

The third transistor may have a channel extending in the first direction, the auxiliary transistor may have a channel extending in the first direction, and the channel of the auxiliary transistor may be arranged on a line different from a line on which the channel of the third transistor extends.

The display device may further include a data pattern which extends in the second direction. Here, an end of the data pattern may form an electrode of the third electrode, and the data pattern may be connected to the electrode of the third transistor through a first contact hole.

A first insulating layer may be disposed on the third transistor, the first scan line and the gate electrode of the third transistor may be disposed on the first insulating layer, and the second scan line may be disposed on a layer different from a layer on which the first scan line is disposed.

The display device may further include a fourth transistor which is connected between the gate electrode of the first transistor and an initialization voltage line, a fifth transistor which is connected between the first electrode of the first transistor and a first power supply voltage wiring, a sixth transistor which is connected between the second electrode of the first transistor and the first electrode of the light emitting element, a seventh transistor which is connected between a cathode electrode of the light emitting element and the initialization voltage line, and a storage capacitor which is formed between the first electrode of the first transistor and the first power supply voltage wiring. Here, each of the fourth and seventh transistors may be the second-type transistor, and each of the fifth and sixth transistors may be the first-type transistor.

The display device may further include an emission control signal line which is connected to a gate electrode of each of the fifth through seventh transistors. Here, the fifth and sixth transistors may be turned on in a third period in response to an emission control signal provided through an emission control signal line, and the seventh transistor may be turned off in the third period in response to the emission control signal.

The light emitting element may be a quantum-dot light emitting element.

According to another exemplary embodiment, a display device includes a light emitting element. A first transistor transmits a driving current to the light emitting element. A second transistor is connected to a first electrode of the first transistor to transmit a data signal. A third transistor is connected between a second electrode of the first transistor and a gate electrode of the first transistor to transmit the data signal to the gate electrode of the first transistor. Here, the third transistor may include first and second sub-transistors having different channel types and connected in series to each other.

The first sub-transistor may be a PMOS transistor, and the second sub-transistor may be an NMOS transistor.

The first sub-transistor may be a top-gate transistor in which a gate electrode is disposed above a semiconductor layer, and the second sub-transistor may be a bottom-gate transistor in which a gate electrode is disposed below a semiconductor layer.

The first sub-transistor may include an oxide semiconductor, and the second sub-transistor may include polycrystalline silicon.

The light emitting element may be a quantum-dot light emitting element.

Therefore, a display device according to an exemplary embodiment can effectively prevent a gate voltage of a first transistor from being dropped by a kickback without significant modifications to the layout.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
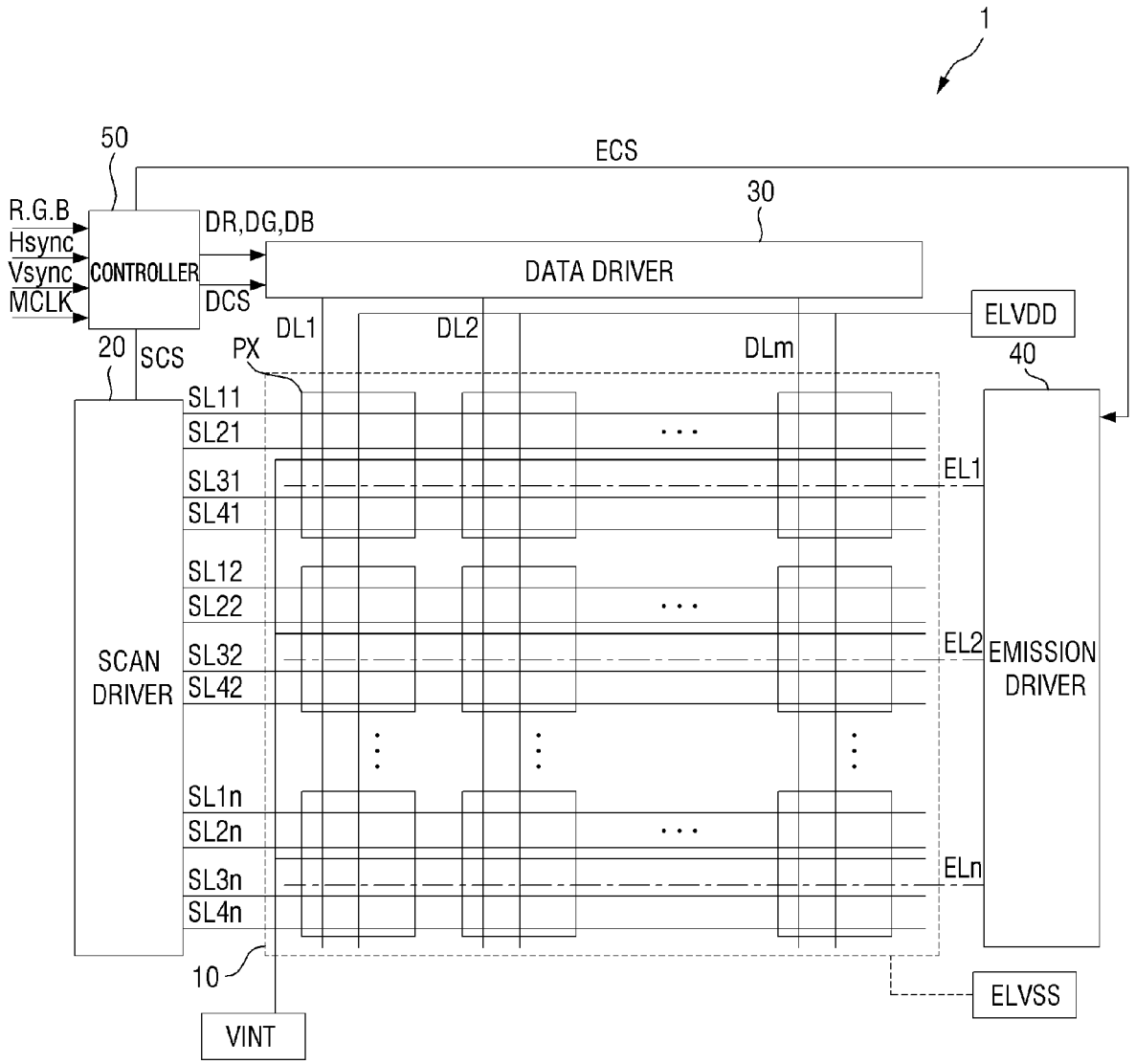
FIG. 1 is a block diagram of a display device according to an exemplary embodiment.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As customary in the field, some exemplary embodiments are described and illustrated in the accompanying drawings in terms of functional blocks, units, and/or modules such as controllers and drivers. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of a display device 1 according to an exemplary embodiment.

Referring to FIG. 1, the display device 1 includes a display unit 10 including pixels PX (or reference pixels or unit pixels), a scan driver 20, a data driver 30, an emission driver 40, and a controller 50.

The display device 1 (or the display unit 10) includes scan lines SL11 through SL1*n*, SL21 through SL2*n*, SL31 through SL3*n* and SL41 through SL4*n* (where n is an integer of 2 or more), data lines DL1 through DLm (where m is an integer of 2 or more), and emission control lines EL1 through ELn. The pixels PX may be disposed at intersections of the scan lines SL11 through SL1*n*, SL21 through SL2*n*, SL31 through SL3*n* and SL41 through SL4*n* (where n is an integer of 2 or more), the data lines DL1 through DLm (where m is an integer of 2 or more) and the emission control lines EL1 through ELn. The pixels PX may be arranged in a matrix form.

The scan lines SL11 through SL1*n*, SL21 through SL2*n*, SL31 through SL3*n* and SL41 through SL4*n* may extend in a row direction. The emission control lines EL1 through ELn may extend in the row direction. The data lines DL1 through DLm may extend in a column direction. The row direction and the column direction can be reversed without departing from the scope of the inventive concepts.

In addition, the display device 1 may include initialization voltage wirings (or initialization voltage supply lines), first power supply voltage wirings (or first power supply voltage supply lines), and second power supply voltage wirings (or second power supply voltage supply lines).

The initialization voltage wirings are wirings for supplying an initialization voltage VINT to the pixels PX and each may branch off in each row to extend in the row direction. The first power supply voltage wirings are wirings for supplying a first power supply voltage ELVDD to the pixels PX and each may branch off in each column to extend in the column direction. The second power supply voltage wirings are wirings for supplying a second power supply voltage ELVSS different from the first power supply voltage ELVDD to the pixels PX and may be arranged in a mesh form. However, the present disclosure is not limited to the above case, and the extending direction of the initialization voltage wirings and the extending direction of the first power supply voltage wirings can be variously changed.

Each of the pixels PX may be connected to four scan lines, one data line, one emission control line, one initialization voltage wiring, and one first power supply voltage wiring. For example, a pixel PX (hereinafter, referred to as an eleventh pixel) located in a first row (or a first pixel row) and a first column (or a first pixel column) may be connected to the eleventh, twenty-first, thirty-first and forty-first scan lines SL11, SL21, SL31 and SL41, the first data line DL1, the first emission control line EL1, one initialization voltage wiring, and one first power supply voltage wiring.

The scan driver 20 may generate first through fourth scan signals and provide the first through fourth scan signals to the pixel PX through the scan lines SL11 through SL1*n*, SL21 through SL2*n*, SL31 through SL3*n* and SL41 through SL4*n*. The first through fourth scan signals will be described later with reference to FIG. 2.

The data driver 30 may provide data signals to the pixels PX through the data lines DL1 through DLm. For example, when the first scan signal is provided to the pixel PX (i.e., the eleventh pixel) in the first row and the first column through the first scan line SL11, a data signal may be provided to the eleventh pixel.

The emission driver 40 may generate emission control signals and provide the emission control signals to the pixels PX through the emission control lines EL1 through ELn. The emission driver 40 (or the display device 1) may adjust emission times of the pixels PX based on the emission control signals. While the emission driver 40 is illustrated as being implemented separately and independently from the scan driver 20, the present disclosure is not limited to this case. For example, the emission driver 40 may be integrally included in the scan driver 20. For another example, the emission driver 40 may be omitted depending on the circuit configuration of the pixels PX.

The controller 50 may convert image signals R, G and B received from the outside (or an external device such as an application processor) into image data signals DR, DG and DB and may transmit the image data signals DR, DG and DB to the data driver 30. In addition, the controller 50 may receive a vertical synchronization signal Vsync, a horizontal synchronization signal Hsync and a clock signal MCLK, generate control signals for controlling the operation (or driving) of the scan driver 20, the data driver 30 and the emission driver 40, and transmit the control signals to the scan driver 20, the data driver 30 and the emission driver 40, respectively. Here, the control signals may include a scan driving control signal SCS for controlling the scan driver 20, a data driving control signal DCS for controlling the data driver 30, and an emission driving control signal ECS for controlling the emission driver 40.

The display device 1 may further include a power supply unit (not illustrated). The power supply unit may generate the first power supply voltage ELVDD, the second power supply voltage ELVSS and the initialization voltage VINT and provide the first power supply voltage ELVDD, the second power supply voltage ELVSS and the initialization voltage VINT to the pixels PX through the first power supply voltage wirings, the second power supply voltage wirings, and the initialization voltage wirings, respectively. The first power supply voltage ELVDD may be a predetermined high-level voltage, and the second power supply voltage ELVSS may be a predetermined low-level voltage. The voltage level of the second power supply voltage ELVSS may be lower than that of the first power supply voltage ELVDD. The power supply unit may be implemented as an external voltage source.

Each of the pixels PX may emit light of a certain luminance based on a driving current supplied to an organic light emitting element according to a data signal received through one of the data lines DL1 through DLm.

Figure 2:
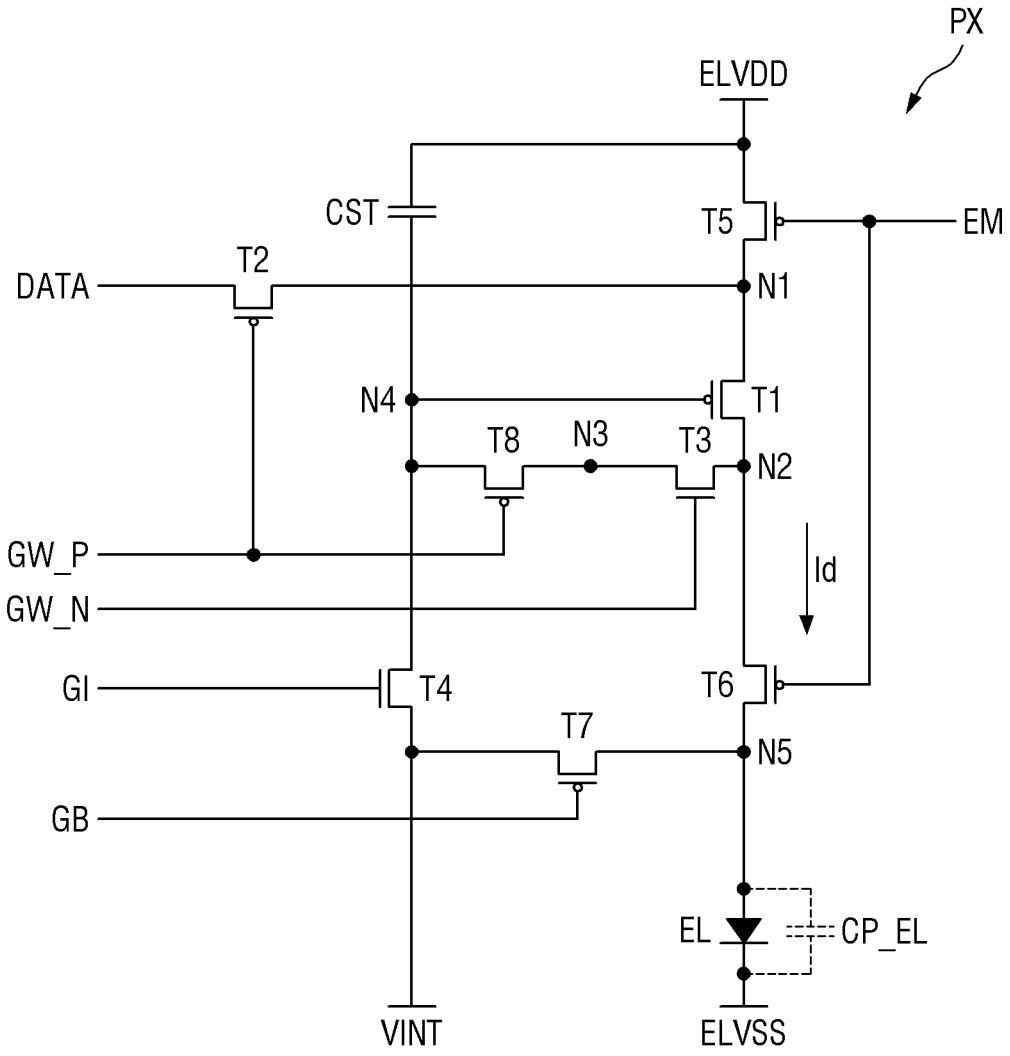
FIG. 2 is a circuit diagram of a pixel included in the display device of FIG. 1.

FIG. 2 is a circuit diagram of a pixel PX included in the display device 1 of FIG. 1.

Referring to FIG. 2, the pixel PX may include a light emitting element EL, first through eighth transistors T1 through T8, and a storage capacitor CST. A data signal DATA, a first scan signal GW_P, a second scan signal GW_N, a third scan signal GI and a fourth scan signal GB may be provided to the pixel PX. Here, the third scan signal GI may be the same as the second scan signal GW_N of a previous time point or a previous row. For example, a third scan signal GI[n] provided to pixels PX in an nth row may be the same as a second scan signal GW_N[n-1] provided to pixels PX in an (n-1)th row. Similarly, the fourth scan signal GB may be the same as the first scan signal GW_P of a previous time point or a previous row. For example, a fourth scan signal GB[n] provided to the pixels PX in the nth row may be the same as a first scan signal GW_P[n-1] provided to the pixels PX in the (n-1)th row.

Each of the first through eighth transistors T1 through T8 may include a first electrode, a second electrode, and a gate electrode. One of the first electrode and the second electrode may be a source electrode, and the other of the first electrode and the second electrode may be a drain electrode.

Each of the first through eighth transistors T1 through T8 may be a thin-film transistor. Each of the first through eighth transistors T1 through T8 may be a P-channel metal-oxide-semiconductor field-effect transistor (PMOS transistor) or an N-channel metal-oxide-semiconductor field-effect transistor (NMOS transistor).

In an exemplary embodiment, each of the first transistor T1, the second transistor T2 and the fifth through eighth transistors T5 through T8 may be a PMOS transistor, and each of the third and fourth transistors T3 and T4 may be an NMOS transistor. The NMOS transistor has a relatively good turn-off characteristic as compared with the PMOS transistor. When each of the third transistor T3 and the fourth transistor T4 is implemented as an NMOS transistor, the leakage of a driving current Id in an emission period of the light emitting element EL may be reduced.

Each of the elements of the pixel PX will now be described in detail.

First, the light emitting element EL may include an anode and a cathode. The anode of the light emitting element EL may be connected to a fifth node N5, and the cathode of the light emitting element EL may be connected to a second power supply voltage wiring for ELVSS.

The first transistor T1 (or a driving transistor) may include a first electrode connected to a first node N1, a second electrode connected to a second node N2, and a gate electrode connected to a fourth node N4. The first transistor T1 may provide the driving current Id to the light emitting element EL based on a voltage of the fourth node N4 (or a data voltage stored in the storage capacitor CST to be described later).

The second transistor T2 (or a switching transistor) may include a first electrode connected to a data line (or receiving the data signal DATA), a second electrode connected to the first node N1, and a gate electrode connected to a first scan line (e.g., the first scan line SL11 illustrated in FIG. 1) or receiving the first scan signal GW_P. The second transistor T2 may be turned on in response to the first scan signal GW_P and may transmit the data signal DATA to the first node N1.

The third transistor T3 and the eighth transistor T8 (or auxiliary transistors) may be connected in series between the second electrode and the gate electrode of the first transistor T1 (or between the second node N2 and the fourth node N4). The third transistor T3 and the eighth transistor T8 may transmit the data signal DATA received through the first and second nodes N1 and N2 to the fourth node N4 (or the storage capacitor CST).

The third transistor T3 may include a first electrode connected to the second node N2, a second electrode connected to a third node N3, and a gate electrode connected to a second scan line (e.g., the second scan line SL21 illustrated in FIG. 1) or receiving the second scan signal GW_N. The third transistor T3 may be turned on in response to the second scan signal GW_N and may transmit the data signal DATA to the third node N3.

The eighth transistor T8 may include a first electrode connected to the third node N3, a second electrode connected to the fourth node N4, and a gate electrode connected to the first scan line (e.g., the first scan line SL11) or receiving the first scan signal GW_P. The eighth transistor T8 may be turned on in response to the first scan signal GW_P and may transmit the data signal DATA to the fourth node N4.

As described above, the third transistor T3 may be implemented as an NMOS transistor to prevent the driving current Id from leaking from the second node N2 to the fourth node N4 during the emission driving of the light emitting element EL. The eighth transistor T8 may be implemented as a PMOS transistor to prevent the voltage of the fourth node N4 (or the gate electrode of the first transistor T1) from being dropped by a kickback voltage of the third transistor T3.

The storage capacitor CST may be connected or formed between the fourth node N4 and the first power supply voltage ELVDD. The storage capacitor CST may store the provided data signal DATA.

The fourth transistor T4 may include a first electrode connected to the fourth node N4, a second electrode connected to an initialization voltage wiring or receiving the initialization voltage VINT, and a gate electrode connected to a third scan line (e.g., the third scan line SL31 illustrated in FIG. 1) or receiving the third scan signal GI.

The fourth transistor T4 may be turned on in response to the third scan signal GI before the data signal DATA is stored in the storage capacitor CST or after the light emitting element EL emits light and may initialize the fourth node N4 (or the storage capacitor CST) using the initialization voltage VINT.

As described above, the fourth transistor T4 implemented as an NMOS transistor can prevent the voltage of the fourth node N4 from dropping while the light emitting element EL is emitting light.

The fifth transistor T5 and the sixth transistor T6 (or first and second emission control transistors) are connected between a first power supply voltage wiring and the light emitting element EL and may form a current path through which the driving current Id generated by the first transistor T1 flows.

The fifth transistor T5 may include a first electrode connected to the first power supply voltage wiring to receive the first power supply voltage ELVDD, a second electrode connected to the first node N1, and a gate electrode connected to an emission control signal line (e.g., the first emission control signal line EL1 illustrated in FIG. 1) or receiving an emission control signal EM.

Similarly, the sixth transistor T6 may include a first electrode connected to the second node N2, a second electrode connected to the fifth node N5 (or the anode of the organic light emitting element OLED), and a gate electrode connected to the emission control signal line (e.g., the first emission control signal line EL1 illustrated in FIG. 1) or receiving the emission control signal EM.

The fifth and sixth transistors T5 and T6 may be turned on in response to the emission control signal EM. In this case, the driving current Id may be supplied to the light emitting element EL, and the light emitting element EL may emit light of a luminance corresponding to the driving current Id.

The seventh transistor T7 may include a first electrode connected to the fifth node N5, a second electrode connected to the initialization voltage wiring (or the initialization voltage VINT), and a gate electrode connected to a fourth scan signal line (e.g., the fourth scan signal line SL41 illustrated in FIG. 1) or receiving the fourth scan signal GB.

The seventh transistor T7 may be turned on in response to the fourth scan signal GB before or after the light emitting element EL emits light and may initialize the anode of the light emitting element EL using the initialization voltage VINT. The light emitting element EL may have a parasitic capacitance CP_EL formed between the anode and the cathode (or the second power supply voltage ELVSS), and the parasitic capacitance CP_EL may be charged while the light emitting element EL emits light, so that the anode of the light emitting element EL can have a specific voltage. Therefore, the light emitting element EL may be initialized by the seventh transistor T7.

In FIG. 2, the eighth transistor T8 is illustrated as being independent of the third transistor T3. However, the present disclosure is not limited to this case. For example, the third transistor T3 and the eighth transistor T8 may be implemented or referred to as one dual-gate transistor.

Figure 3A:
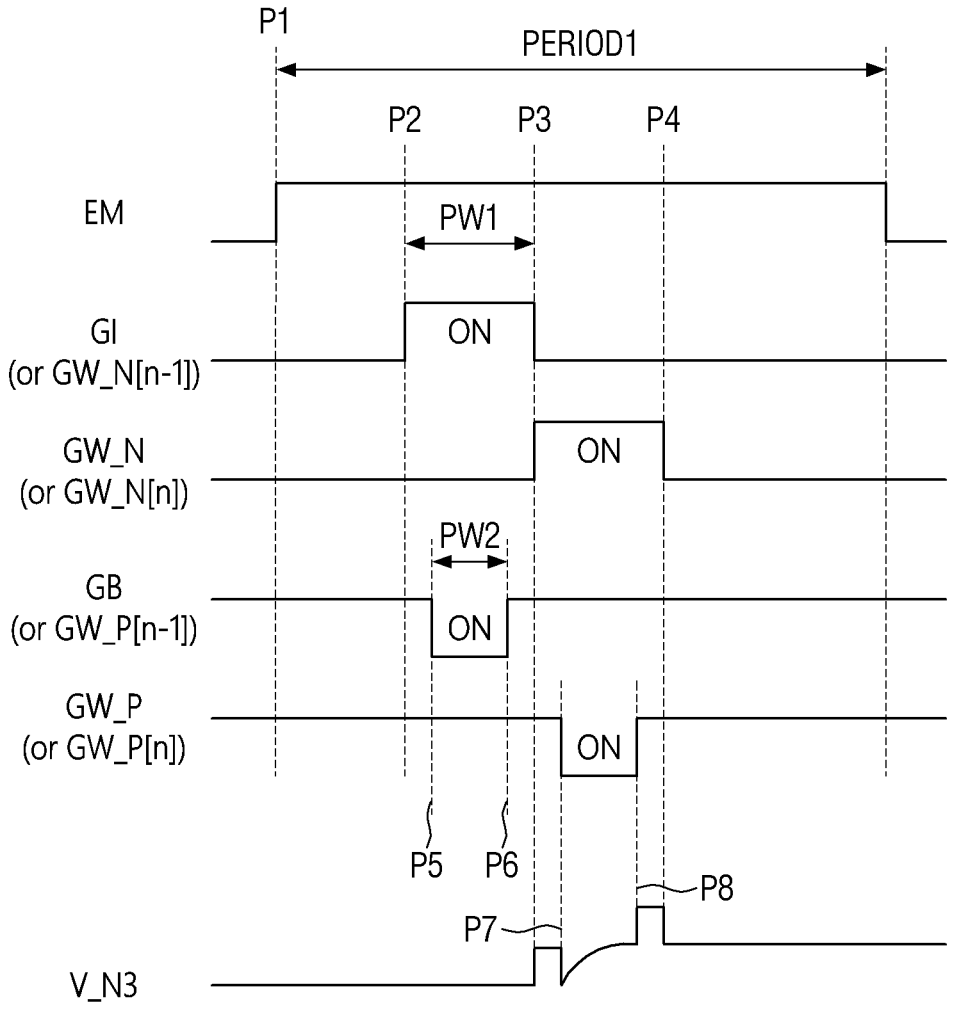
FIGS. 3A, 3B, and 3C are waveform diagrams of signals provided to the pixel of FIG. 2.
Figure 3B:
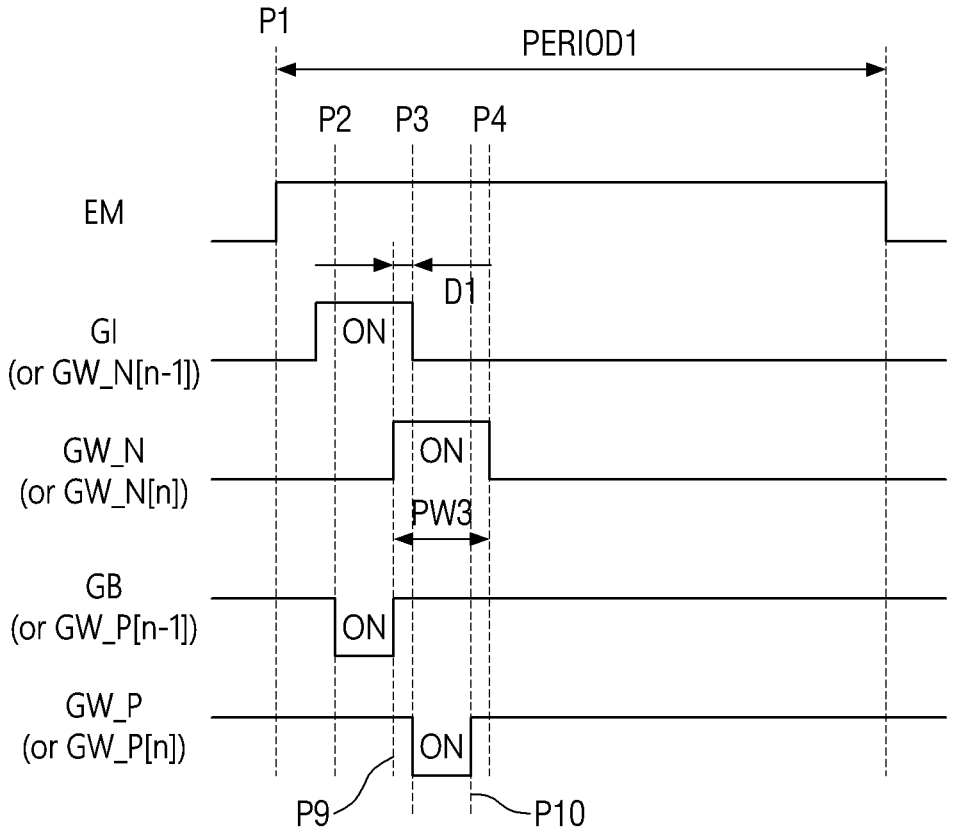
Figure 3C:
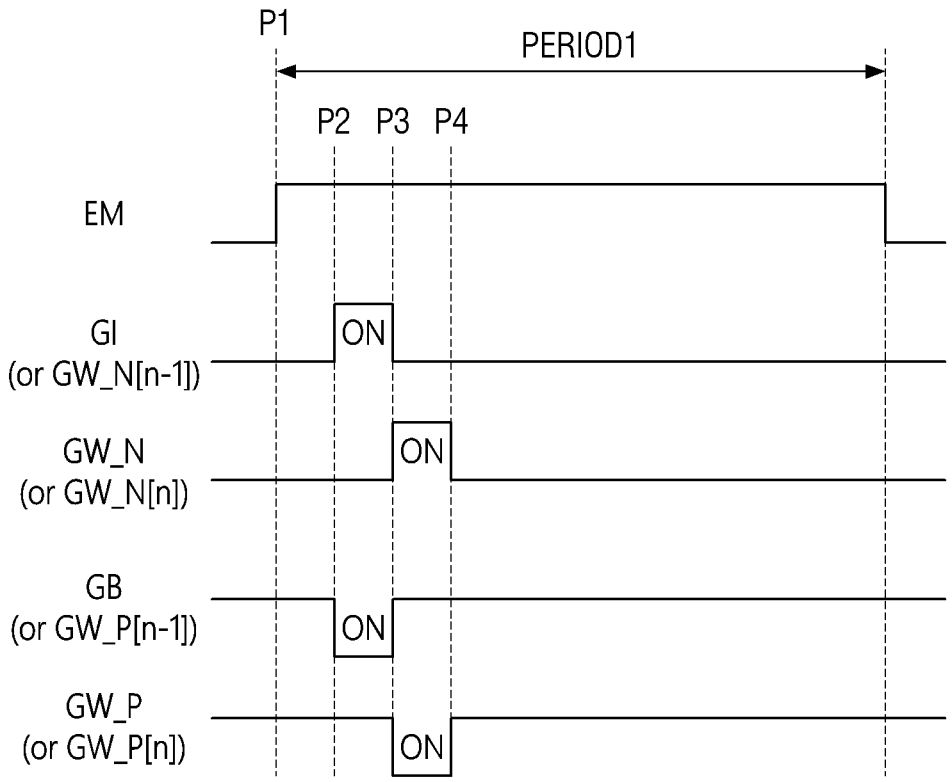

FIGS. 3A through 3C are waveform diagrams of signals provided to the pixel PX of FIG. 2.

Referring to FIGS. 2 and 3A, the emission signal EM may have a high-level voltage (or a logic high level or a turn-off voltage) in a first period PERIOD1 (e.g., a specific period from a first time point P1) and may have a low-level voltage (or a logic low level or a turn-on voltage) in the remaining period excluding the first period PERIOD1.

The third scan signal GI (or the previous second scan signal GW_N[n-1]) may have a high-level voltage in a period between a second time point P2 and a third time point P3. The third scan signal GI may have a low-level voltage in the other periods of the first period PERIOD1 (e.g., a period from the first time point P1 to the second time point P2 and a period after the third time point P3). The third scan signal GI (or the previous second scan signal GW_N[n-1]) may be an impulse signal having a first pulse width PW1.

In this case, the fourth transistor T4 described with reference to FIG. 2 may be turned on in the period between the second time point P2 and the third time point P3 and may initialize the fourth node N4 using the initialization voltage VINT.

The fourth scan signal GB (or the previous first scan signal GW_P[n-1]) may have a low-level voltage in a period between a fifth point of time P5 and a sixth point of time P6. Here, the fifth time point P5 may be after the second time point P2, and the sixth time point P6 may be before the third time point P3. The fourth scan signal GB may be an impulse signal having a second pulse width PW2, and the second pulse width PW2 may be smaller than the first pulse width PW1 and may be completely overlapped by the first pulse width PW1.

In this case, the seventh transistor T7 described with reference to FIG. 2 may be turned on in the period between the fifth time point P5 and the sixth time point P6 (or in the period between the second time point P2 and the third time point P3) and may initialize the light emitting element EL using the initialization voltage VINT.

The second scan signal GW_N (or a current second scan signal GW_N[n]) may have a high-level voltage in a period between the third time point P3 and a fourth time point P4. Like the third scan signal GI, the second scan signal GW_N (or the current second scan signal GW_N[n]) may be an impulse signal having the first pulse width PW1. That is, the second scan signal GW_N may be a signal obtained by delaying the third scan signal GI by the first pulse width PW1.

The first scan signal GW_P (or a current first scan signal GW_P[n]) may have a low-level voltage in a period between a seventh time point P7 and an eighth time point P8. Here, the seventh time point P7 may be after the third time point P3, and the eighth time point P8 may be before the fourth time point P4. The first scan signal GW_P may be an impulse signal having the second pulse width PW2. That is, the first scan signal GW_P may be a signal obtained by delaying the fourth scan signal GB by the first pulse width PW1.

The third transistor T3 illustrated in FIG. 2 may be turned on at the third time point P3 in response to the second scan signal GW_N. In this case, a third node voltage V_N3 which is a voltage of the third node N3 may be temporarily raised by the kickback voltage (or turn-on kickback) of the third transistor T3. Since the third transistor T3 is implemented as an NMOS transistor, the kickback voltage due to the turn-on of the third transistor T3 may be generated in a positive direction.

Then, the eighth transistor T8 may be turned on at the seventh time point P7 in response to the first scan signal GW_P. In this case, the third node voltage V_N3 may be temporarily lowered (or dropped) by the kickback voltage (or turn-on kickback) of the eighth transistor T8. Since the eighth transistor T8 is implemented as a PMOS transistor, the kickback voltage due to the turn-on of the eighth transistor T8 may be generated in a negative direction. When the capacitance of the eighth transistor T8 is similar to that of the third transistor T3 and the position of the eighth transistor T8 in cross-sectional view is similar to that of the third transistor T3, the magnitude of the kickback voltage of the eighth transistor T8 may be the same as or similar to the magnitude of the kickback voltage of the third transistor T3.

While the third transistor T3 and the eighth transistor T8 are turned on (i.e., in the period between the seventh time point P7 and the eighth time point P8), the data signal DATA may be transmitted from the second node N2 to the fourth node N4 via the third node N3, and the third node voltage V_N3 (and the voltage of the fourth node N4) may be linearly increased by the transmission of the data signal DATA.

Then, the eighth transistor T8 may be turned off at the eighth time point P8 in response to the first scan signal GW_P. In this case, the third node voltage V_N3 may be temporarily raised by the kickback voltage of the eighth transistor T8.

The third transistor T3 may be turned off at the fourth time point P4 in response to the second scan signal GW_N. In this case, the third node voltage V_N3 may be temporarily dropped by the kickback voltage of the eighth transistor T8.

In the pixel circuit illustrated in FIG. 2, if the second node N2 and the third node N3 are connected only by the third transistor T3, the voltage of the fourth node N4 (i.e., a gate voltage of the first transistor T1) may be dropped by the kickback voltage of the third transistor T3 at the third time point P3. Accordingly, the pixel PX may emit light of a luminance different from a desired luminance.

Therefore, the eighth transistor T8 may be additionally placed between the second node N2 and the third node N3 of the pixel PX and may be turned on and turned off in a period in which the third transistor T3 is turned on. Therefore, it is possible to compensate for a drop in the third node voltage V_N3 (or the gate voltage of the first transistor T1) due to the kickback voltage of the third transistor T3.

In FIG. 3A, the second scan signal GW_N is illustrated as not overlapping the third scan signal GI. However, this is only an example, and the present disclosure is not limited to this example.

Referring to FIG. 3B, for example, the second scan signal GW_N may transit to a high level-voltage at a ninth time point P9 which is before a third time point P3. In this case, the second scan signal GW_N may overlap the third scan signal GI in a period between the ninth time point P9 and the third time point P3 (i.e., during a first time D1). Meanwhile, the first scan signal GW_P may transit to a low-level voltage at the third time point P3 and may transit to a high-level voltage at a tenth time point P10. That is, the first scan signal GW_P may be included in or overlapped by the second scan signal GW_N, but may not overlap the third scan signal GI.

In FIG. 3A, the second scan signal GW_N is illustrated as having a width greater than the width of the first scan signal GW_P. However, this is only an example, and the present disclosure is not limited to this example.

Referring to FIG. 3C, for example, the first through fourth scan signals GW_P, GW_N, GI and GB may have the same width.

As described above with reference to FIGS. 3A through 3C, the first scan signal GW_P may overlap the second scan signal GW_N, and the kickback voltage due to the third transistor T3 operating in response to the second scan signal GW_N may be compensated for by the kickback voltage due to the eighth transistor T8 operating in response to the first scan signal GW_P.

Figure 4:
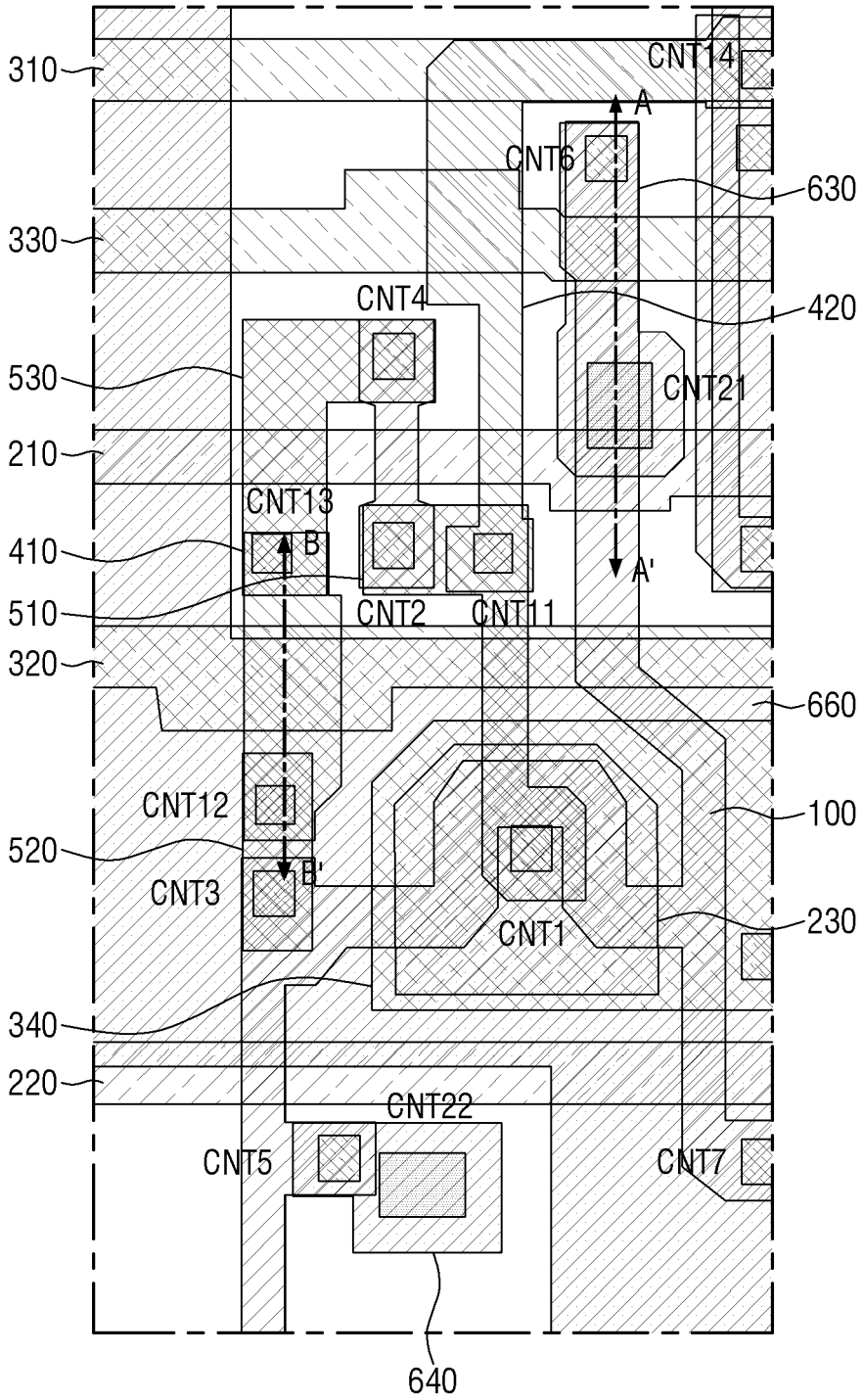
FIG. 4 is a layout view of the pixel of FIG. 2.
Figure 5:
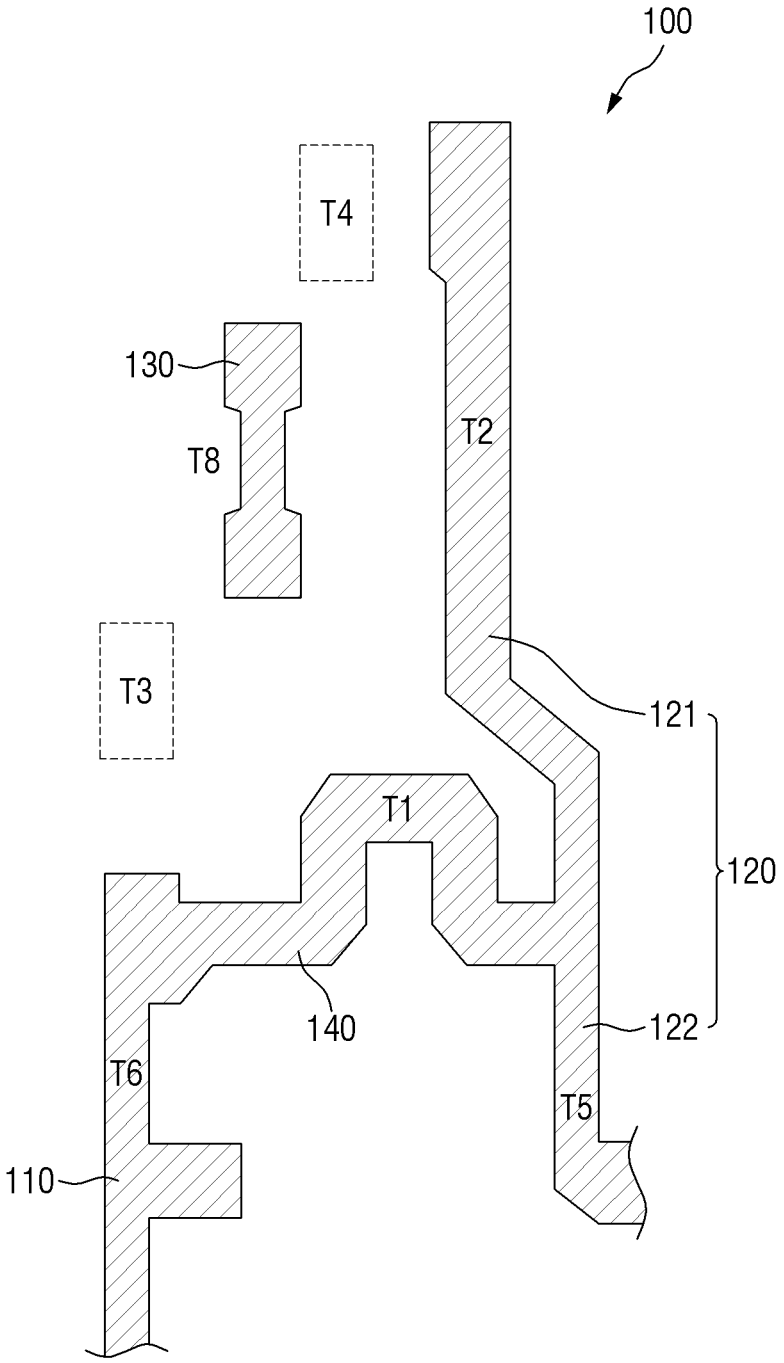
FIG. 5 is a plan view of a lower semiconductor layer included in the pixel of FIG. 4.
Figure 6:
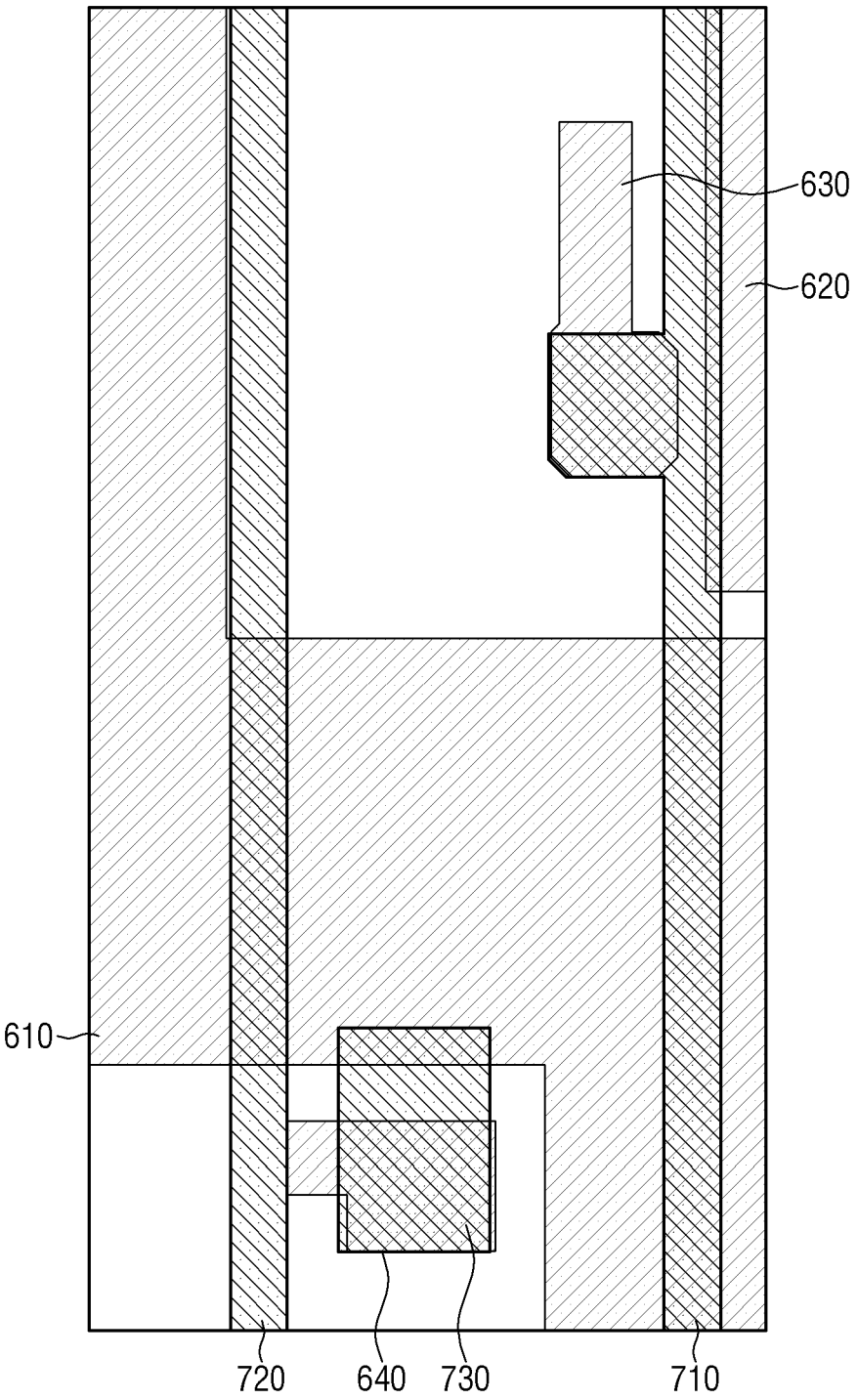
FIG. 6 is a plan view in which fourth and fifth conductive layers included in the pixel of FIG. 4 overlap each other.
Figure 7:
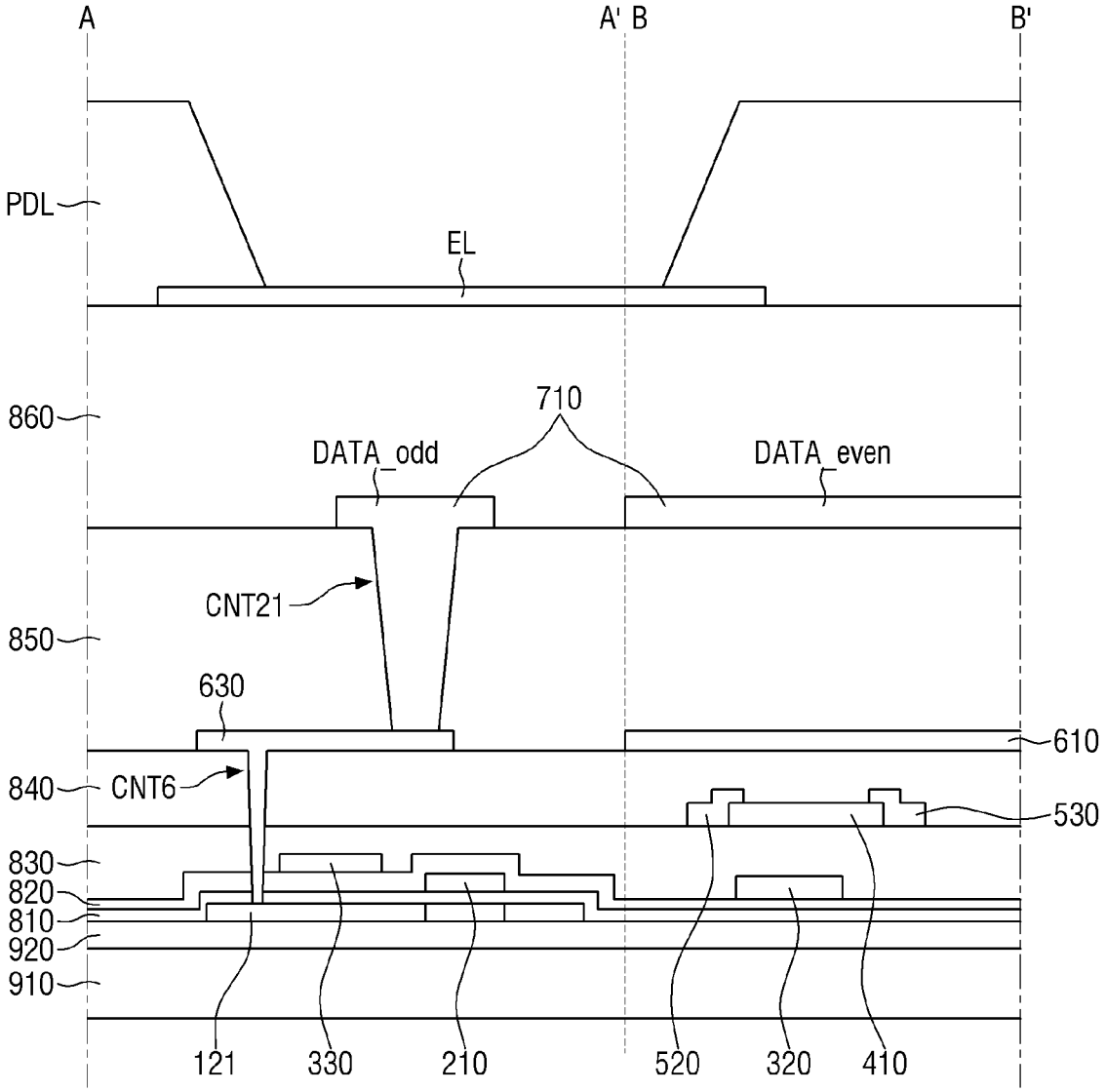
FIG. 7 is a cross-sectional view taken along lines A-A' and B-B' of FIG. 4.

FIG. 4 is a layout view of the pixel PX of FIG. 2. FIG. 5 is a plan view of a lower semiconductor layer 100 included in the pixel PX of FIG. 4. FIG. 6 is a plan view in which fourth and fifth conductive layers 600 and 700 included in the pixel PX of FIG. 4 overlap each other. FIG. 7 is a cross-sectional view taken along line I-I' of FIG. 4.

In the following embodiments, some elements are given new reference numerals even though they are substantially the same as those mentioned in FIGS. 1 and 2 in order to easily describe the arrangement and coupling relationship among elements.

Referring to FIGS. 2 and 4 through 7, the pixel PX may include the first through eighth transistors T1 through T8, the storage capacitor CST, and the light emitting element EL.

Each of the first through eighth transistors T1 through T8 may include a conductive layer that forms an electrode, a semiconductor layer that forms a channel, and an insulating layer. The first transistor T1, the second transistor T2 and the fifth through eighth transistors T5 through T8 which are PMOS transistors may each be a top-gate transistor in which a gate electrode is disposed above a semiconductor layer, and the third and fourth transistors T3 and T4 which are NMOS transistors may each be a bottom-gate transistor in which a gate electrode is disposed below a semiconductor layer.

The storage capacitor CST may include conductive layers that form electrodes and an insulating layer disposed between the conductive layers.

The light emitting element EL may include conductive layers that form the anode and the cathode and a light emitting layer disposed between the conductive layers.

In some embodiments, the light emitting layer of the light emitting element EL may be an organic light emitting layer. That is, in some embodiments, the light emitting element EL may be an organic light emitting diode.

Alternatively, in some embodiments, the light emitting layer of the light emitting element EL may include a quantum-dot material. That is, in some embodiments, the light emitting element EL may be a quantum-dot light emitting diode.

Quantum dots may be particulate materials that emit light of a specific color when electrons transit from a conduction band to a valence band.

The quantum dots may be semiconductor nanocrystalline materials. The quantum dots may have a specific band gap according to their composition and size. Thus, the quantum dots may absorb light and then emit light having a unique wavelength. Examples of semiconductor nanocrystals of the quantum dots include group IV nanocrystals, group II-VI compound nanocrystals, group III-V compound nanocrystals, group IV-VI nanocrystals, and combinations of the same.

The group II-VI compounds may be selected from binary compounds selected from CdSe, CdTe, ZnS, ZnSe, ZnTe, ZnO, HgS, HgSe, HgTe, MgSe, MgS and mixtures of the same; ternary compounds selected from InZnP, AgInS, CuInS, CdSeS, CdSeTe, CdSTe, ZnSeS, ZnSeTe, ZnSTe, HgSeS, HgSeTe, HgSTe, CdZnS, CdZnSe, CdZnTe, CdHgS, CdHgSe, CdHgTe, HgZnS, HgZnSe, HgZnTe, MgZnSe, MgZnS and mixtures of the same; and quaternary compounds selected from HgZnTeS, CdZnSeS, CdZnSeTe, CdZnSTe, CdHgSeS, CdHgSeTe, CdHgSTe, HgZnSeS, HgZnSeTe, HgZnSTe and mixtures of the same.

The group III-V compounds may be selected from binary compounds selected from GaN, GaP, GaAs, GaSb, AlN, AlP, AlAs, AlSb, InN, InP, InAs, InSb and mixtures of the same; ternary compounds selected from GaNP, GaNAs, GaNSb, GaPAs, GaPSb, AlNP, AlNAs, AlNSb, AlPAs, AlPSb, InGaP, InNP, InAlP, InNAs, InNSb, InPAs, InPSb, GaAlNP and mixtures of the same; and quaternary compounds selected from GaAlNAs, GaAlNSb, GaAlPAs, GaAlPSb, GaInNP, GaInNAs, GaInNSb, GaInPAs, GaInPSb, InAlNP, InAlNAs, InAlNSb, InAlPAs, InAlPSb and mixtures of the same.

The group IV-VI compounds may be selected from binary compounds selected from SnS, SnSe, SnTe, PbS, PbSe, PbTe and mixtures of the same; ternary compounds selected from SnSeS, SnSeTe, SnSTe, PbSeS, PbSeTe, PbSTe, SnPbS, SnPbSe, SnPbTe and mixtures of the same; and quaternary compounds selected from SnPbSSe, SnPbSeTe, SnPbSTe and mixtures of the same. The group IV elements may be selected from silicon (Si), germanium (Ge), and a mixture of the same. The group IV compounds may be binary compounds selected from silicon carbide (SiC), silicon germanium (SiGe), and a mixture of the same.

Here, the binary, ternary or quaternary compounds may be present in the particles at a uniform concentration or may be present in the same particles at partially different concentrations. In addition, they may have a core/shell structure in which one quantum dot surrounds another quantum dot. An interface between the core and the shell may have a concentration gradient in which the concentration of an element present in the shell is reduced toward the center.

In some embodiments, the quantum dots may have a core-shell structure including a core containing the above-described nanocrystal and a shell surrounding the core. The shell of each quantum dot may serve as a protective layer for maintaining semiconductor characteristics by preventing chemical denaturation of the core and/or as a charging layer for giving electrophoretic characteristics to the quantum dot. The shell may be a single layer or a multilayer. An interface between the core and the shell may have a concentration gradient in which the concentration of an element present in the shell is reduced toward the center. The shell of each quantum dot may be, for example, a metal or non-metal oxide, a semiconductor compound, or a combination of the same.

For example, the metal or non-metal oxide may be, but is not limited to, a binary compound such as $SiO_2$, $Al_2O_3$, $TiO_2$, ZnO, MnO, $Mn_2O_3$, $Mn_3O_4$, CuO, FeO, $Fe_2O_3$, $Fe_3O_4$, CoO, $Co_3O_4$ or NiO or a ternary compound such as $MgAl_2O_4$, $CoFe_2O_4$, $NiFe_2O_4$ or $CoMn_2O_4$.

In addition, the semiconductor compound may be, but is not limited to, CdS, CdSe, CdTe, ZnS, ZnSe, ZnTe, ZnSeS, ZnTeS, GaAs, GaP, GaSb, HgS, HgSe, HgTe, InAs, InP, InGaP, InSb, AlAs, AlP, or AlSb.

When the light emitting layer of the light emitting element EL includes quantum dots, light emitted from the light emitting element EL may have a full width of half maximum (FWHM) of an emission wavelength spectrum of about 45 nm or less, about 40 nm or less, or about 30 nm or less.

Therefore, the color purity and color gamut of the display device 1 can be further improved.

The electrical connection between elements may be achieved by a wiring made of a conductive layer and/or a via made of a conductive material. The conductive material, the conductive layers, the semiconductor layers, the insulating layers, the light emitting layer, etc. are disposed on a substrate 910.

The pixel PX may include the substrate 910, a buffer layer 920, the lower semiconductor layer 100, a first insulating layer 810, a first conductive layer 200, a second insulating layer 820, a second conductive layer 300, a third insulating layer 830, an upper semiconductor layer 400, a third conductive layer 500, a fourth insulating layer 840, the fourth conductive layer 600, a fifth insulating layer 850, and the fifth conductive layer 700. The substrate 910, the buffer layer 920, the lower semiconductor layer 100, the first insulating layer 810, the first conductive layer 200, the second insulating layer 820, the second conductive layer 300, the third insulating layer 830, the upper semiconductor layer 400, the third conductive layer 500, the fourth insulating layer 840, the fourth conductive layer 600, the fifth insulating layer 850, and the fifth conductive layer 700 may be sequentially arranged or laminated.

Each of the layers described above may be a single layer or a laminated layer including a plurality of layers. Another layer may also be disposed between the layers.

The substrate 910 supports the layers disposed thereon. If the display device 1 is of a bottom emission type or a both-sided emission type, a transparent substrate may be used. If the display device 1 is of a top emission type, not only a transparent substrate but also a semitransparent or opaque substrate can be applied.

The substrate 910 may be made of an insulating material such as glass, quartz, or polymer resin. Examples of the polymer material may include polyethersulphone (PES), polyacrylate (PA), polyarylate (PAR), polyetherimide (PEI), polyethylene naphthalate (PEN), polyethylene terepthalate (PET), polyphenylene sulfide (PPS), polyallylate, polyimide (PI), polycarbonate (PC), cellulose triacetate (CAT), cellulose acetate propionate (CAP), and combinations of these materials. The substrate 910 may also include a metallic material.

The substrate 910 may be a rigid substrate or a flexible substrate that can be bent, folded, or rolled. An example of the material that forms the flexible substrate may be polyimide (PI).

The buffer layer 920 may be disposed on the entire surface of the substrate 910. The buffer layer 920 may prevent diffusion of impurity ions, prevent penetration of moisture or outside air, and perform a surface planarization function. The buffer layer 920 may include silicon nitride, silicon oxide, or silicon oxynitride. The buffer layer 920 may be omitted depending on the type of the substrate 910 or process conditions.

The lower semiconductor layer 100 is an active layer that forms channels of the first transistor T1, the second transistor T2 and the fifth through eighth transistors T5 through T8.

The lower semiconductor layer 100 may be provided separately in each pixel, but the present disclosure is not limited to this case. For example, two pixels adjacent in the row direction may have pixel structures horizontally inverted with respect to each other and may share one lower semiconductor layer.

The lower semiconductor layer 100 may include first and second lower semiconductor patterns separated from each other within the pixel PX.

The lower semiconductor layer 100 may include a first vertical part 110, a second vertical part 120, a third vertical part 130, and a horizontal part 140 generally extending in the row direction. The first vertical part 110, the second vertical part 120, and the horizontal part 140 may be physically connected to form the first lower semiconductor pattern. The third vertical part 130 may form the second lower semiconductor pattern.

The first vertical part 110 may be disposed adjacent to a left side of the pixel PX, the second vertical part 120 may be disposed adjacent to a right side of the pixel PX, and the third vertical part 130 may be disposed adjacent to the left side of the pixel PX. The first vertical part 110, the second vertical part 120, and the third vertical part 130 may be spaced apart from each other. The length of the second vertical part 120 in the column direction may be greater than the length of the first vertical part 110 and may also be greater than the length of the third vertical part 130. In addition, the length of the first vertical part 110 may be greater than the length of the third vertical part 130.

The horizontal part 140 may connect an end (e.g., an upper end) of the first vertical part 110 to a middle portion of the second vertical part 120. In the present specification, an "upper portion 121" of the second vertical part 120 may refer to a portion located above a connection portion with the horizontal part 140 in plan view based on FIG. 4, and a "lower portion 122" of the second vertical part 120 may refer to a portion located below the connection portion with the horizontal part 140 in plan view.

The horizontal part 140 may connect the first vertical part 110 and the second vertical part 120 at the shortest distance, but may include a first bent portion on the left side and a second bent portion on the right side, as illustrated in FIG. 5. The total length of the horizontal part 140 may be increased by multiple bends.

The third vertical part 130 may be spaced apart from the first and second vertical parts 110 and 120 and the horizontal part 140 to be disposed in an island shape.

The channel of the first transistor T1 may be disposed in the horizontal part 140, the channel of the second transistor T2 may be in the upper portion 121 of the second vertical part 120, the channel of the fifth transistor T5 may be disposed in the lower portion 122 of the second vertical part 120, the channel of the sixth transistor T6 may be disposed in the first vertical part 110, and the channel of the eighth transistor T8 may be disposed in the third vertical part 130. Although not illustrated, the channel of the seventh transistor T7 may be disposed below the first vertical part 110.

The lower semiconductor layer 100 may include polycrystalline silicon. The polycrystalline silicon may be formed by crystallizing amorphous silicon. Examples of the crystallization method include rapid thermal annealing (RTA), solid phase crystallization (SPC), excimer laser annealing (ELA), metal induced crystallization (MIC), metal induced lateral crystallization (MILC), and sequential lateral solidification (SLS). In another example, the lower semiconductor layer 100 may include monocrystalline silicon, low-temperature polycrystalline silicon, amorphous silicon, or the like.

Portions (source/drain regions) of the lower semiconductor layer 100 which are connected to respective source/drain electrodes of the first, second and fifth through eighth transistors T1, T2 and T5 through T8 may be doped with impurity ions (p-type impurity ions in the case of PMOS transistors). A trivalent dopant such as boron (B) may be used as the p-type impurity ions.

The first insulating layer 810 may be disposed on the lower semiconductor layer 100 and may generally be disposed over the entire surface of the substrate 910. The first insulating layer 810 may be a gate insulating layer having a gate insulating function.

The first insulating layer 810 may include a silicon compound, a metal oxide, or the like. For example, the first insulating layer 810 may include silicon oxide, silicon nitride, silicon oxynitride, aluminum oxide, tantalum oxide, hafnium oxide, zirconium oxide, titanium oxide, etc. These materials may be used alone or in combination with each other. The first insulating layer 810 may be a single layer or a multilayer consisting of laminated layers of different materials.

The first conductive layer 200 is disposed on the first insulating layer 810. The first conductive layer 200 may include a first scan line 210 which transmits the first scan signal GW_P, an emission control line 220 which transmits the emission control signal EM, and a gate electrode 230 of the first transistor T1.

The first scan line 210 may include the gate electrode of the second transistor T2 and the gate electrode of the eighth transistor T8, and the emission control line 220 may include the gate electrode of the fifth transistor T5 and the gate electrode of the sixth transistor T6.

Each of the first scan line 210 and the emission control line 220 may extend along the row direction. Each of the first scan line 210 and the first emission control line 220 may extend along the row direction to neighboring pixels beyond boundaries of the pixel PX.

The first scan line 210 may be located in an upper part of the pixel PX in plan view. The first scan line 210 may overlap the upper portion 121 of the second vertical part 120 of the lower semiconductor layer 100, and the gate electrode of the second transistor T2 may be formed in an overlap area where the first scan line 210 and the second vertical part 120 of the lower semiconductor layer 100 overlap. The second vertical part 120 of the lower semiconductor layer 100 located above the overlap area may be a first electrode area (or an area where the first electrode is formed) of the second transistor T2, and the second vertical part 120 of the lower semiconductor layer 100 located below the overlap area may be a second electrode area of the second transistor T2.

Similarly, the first scan line 210 may overlap the third vertical part 130 of the lower semiconductor layer 100, and the gate electrode of the eighth transistor T8 may be formed in an overlap area where the first vertical scan line 210 and the third vertical part 130 of the lower semiconductor layer 100 overlap. The third vertical part 130 of the lower semiconductor layer 100 located above the overlap area may be a first electrode area of the eighth transistor T8, and the third vertical part 130 of the lower semiconductor layer 100 located below the overlap area may be a second electrode area of the eighth transistor T8.

The emission control line 220 may be located in a lower part of the pixel PX in plan view. The emission control line 220 may be located below the first scan line 210. The emission control line 220 may overlap the first vertical part 110 of the lower semiconductor layer 100 and the lower portion 122 of the second vertical part 120.

The gate electrode of the sixth transistor T6 may be formed in an overlap area where the emission control line 220 and the first vertical part 110 of the lower semiconductor layer 100 overlap. The first vertical part 110 of the lower semiconductor layer 100 located above the overlap area may be a second electrode area of the sixth transistor T6, and the first vertical part 110 of the lower semiconductor layer 100 located below the overlap area may be a first electrode area of the sixth transistor T6.

Similarly, the gate electrode of the fifth transistor T5 may be formed in an overlap area where the emission control line 220 and the lower portion 122 of the second vertical part 120 of the lower semiconductor layer 100 overlap. The second vertical part 120 of the lower semiconductor layer 100 located above the overlap area may be a first electrode area of the fifth transistor T5, and the second vertical part 120 of the lower semiconductor layer 100 located below the overlap area may be a second electrode area of the fifth transistor T5.

The gate electrode of the second transistor T2, the gate electrode of the fifth transistor T5, and the gate electrode of the sixth transistor T6 may be, but are not necessarily, wider than surrounding lines.

The gate electrode 230 of the first transistor T1 may be located in a central part of the pixel PX. The gate electrode 230 of the first transistor T1 may be located between the first scan line 210 and the emission control line 220 in plan view. The gate electrode 230 of the first transistor T1 may be provided separately in each pixel and may be disposed in an island shape.

The gate electrode 230 of the first transistor T1 may overlap the horizontal part 140 of the lower semiconductor layer 100. The horizontal part 140 of the lower semiconductor layer 100 located on the left side of an overlap area where the gate electrode 230 of the first transistor T1 overlaps the horizontal part 140 of the lower semiconductor layer 100 may be a first electrode area of the first transistor T1, and the horizontal part 140 of the lower semiconductor layer 100 located on the right side of the overlap area may be a second electrode area of the first transistor T1.

The first conductive layer 200 may include one or more metals selected from molybdenum (Mo), aluminum (Al), platinum (Pt), palladium (Pd), silver (Ag), magnesium (Mg), gold (Au), nickel (Ni), neodymium (Nd), iridium (Ir), chromium (Cr), calcium (Ca), titanium (Ti), tantalum (Ta), tungsten (W) and copper (Cu). The first conductive layer 200 may be a single layer or a multilayer.

The second insulating layer 820 may be disposed on the first conductive layer 200 and may be disposed over the entire surface of the substrate 910. The second insulating layer 820 may serve to insulate the first conductive layer 200 from the second conductive layer 300 and may be an interlayer insulating film.

The second insulating layer 820 may include an inorganic insulating material such as silicon oxide, silicon nitride, silicon oxynitride, hafnium oxide, aluminum oxide, titanium oxide, tantalum oxide or zinc oxide, or include an organic insulating material such as polyacrylate resin, epoxy resin, phenolic resin, polyamide resin, polyimide resin, unsaturated polyester resin, polyphenylenether resin, polyphenylenesulfide resin or benzocyclobutene (BCB). The second insulating layer 820 may be a single layer or a multilayer consisting of laminated layers of different materials.

The second conductive layer 300 is disposed on the second insulating layer 820. The second conductive layer 300 may include an initialization voltage line 310 which transmits the initialization voltage VINT, a second scan line 320 which transmits the second scan signal GW_N, a third scan line 330 which transmits the third scan signal GI, and an electrode line 340 of the storage capacitor CST. In addition, the second conductive layer 300 may include gate wirings of the third and fourth transistors T3 and T4.

Each of the initialization voltage line 310, the second scan line 320, the third scan line 330, and the storage capacitor electrode line 340 may extend along the row direction. The initialization voltage line 310, the second scan line 320, the third scan line 330, and the storage capacitor electrode line 340 may extend along the row direction to the neighboring pixels beyond the boundaries of the pixel PX.

The initialization voltage line 310 may be located at the top of the pixel PX in plan view.

The second scan line 320 may be located above the first scan line 210 and below the initialization voltage line 310 in plan view. The second scan line 320 may include the gate electrode of the third transistor T3.

The third scan line 330 may be located below the initialization voltage line 310 and above the second scan line 320 in plan view. The third scan line 330 may include the gate electrode of the fourth transistor T4.

The gate electrode of the third transistor T3 and the gate electrode of the fourth transistor T4 may be, but are not necessarily, wider than surrounding lines.

The electrode line 340 of the storage capacitor CST may cross the central part of the pixel PX and may be disposed between the second scan line 320 and the emission control line 220 in plan view. The electrode line 340 of the storage capacitor CST may overlap the gate electrode 230 of the first transistor T1 with the second insulating layer 820 interposed between them. The gate electrode 230 of the first transistor T1 may be the first electrode of the storage capacitor CST, and an extended area of the electrode line 340 of the storage capacitor CST which overlaps the gate electrode 230 of the first transistor T1 may be the second electrode of the storage capacitor CST, and the second insulating layer 820 interposed between the electrode line 340 of the storage capacitor CST and the gate electrode 230 of the first transistor T1 may be a dielectric of the storage capacitor CST.

The width of the electrode line 340 of the storage capacitor may have extended area in an area overlapping the gate electrode 230 of the first transistor T1. The electrode line 340 of the storage capacitor CST may include an opening overlapping the gate electrode 230 of the first transistor T1 in the extended area.

The second conductive layer 300 may include one or more metals selected from molybdenum (Mo), aluminum (Al), platinum (Pt), palladium (Pd), silver (Ag), magnesium (Mg), gold (Au), nickel (Ni), neodymium (Nd), iridium (Ir), chromium (Cr), calcium (Ca), titanium (Ti), tantalum (Ta), tungsten (W) and copper (Cu).

The third insulating layer 830 may be disposed on the second conductive layer 300 and may cover the second conductive layer 300. The third insulating layer 830 may be generally disposed over the entire surface of the substrate 910. The third insulating layer 830 may be a gate insulating layer having a gate insulating function. The third insulating layer 830 may include the same material as the first insulating layer 810 or may include one or more materials selected from the materials exemplified as the material of the first insulating layer 810. The third insulating layer 830 may be a single layer or a multilayer consisting of laminated layers of different materials.

The upper semiconductor layer 400 may be disposed on the third insulating layer 830. The upper semiconductor layer 400 may include first and second upper semiconductor patterns 410 and 420 separated from each other within the pixel PX.

The first upper semiconductor pattern 410 may overlap the gate electrode of the third transistor T3 to form a channel of the third transistor T3. Similarly, the second upper semiconductor pattern 420 may overlap the gate electrode of the fourth transistor T4 to form a channel of the fourth transistor T4. The first upper semiconductor pattern 410 may have, but is not limited to, a rectangular shape.

The upper semiconductor layer 400 may include an oxide semiconductor. Examples of the oxide semiconductor may include a binary compound ($AB_X$), a ternary compound ($AB_XC_Y$) and a quaternary compound ($AB_XC_YD_Z$) containing indium, zinc, gallium, tin, titanium, aluminum, hafnium (Hf), zirconium (Zr), magnesium (Mg), etc. In an exemplary embodiment, the upper semiconductor layer 400 may include ITZO (an oxide including indium, tin and titanium) or IGZO (an oxide including indium, gallium and tin).

The third conductive layer 500 may include first through fourth data patterns 510 through 530.

The first through fourth data patterns 510 through 530 may be physically spaced apart from each other. Each of the first through fourth data patterns 510 through 530 may electrically connect distant portions of the first, third, fourth and eighth transistors T1, T3, T4 and T8 and may form a first electrode or a second electrode of an NMOS transistor (e.g., the third transistor T3). When the third conductive layer 500 overlaps the upper semiconductor layer 400, it may contact an upper surface of the upper semiconductor layer 400 directly or through an ohmic contact layer.

The first data pattern 510 may overlap the gate electrode 230 of the first transistor T1. In an overlap area (i.e., an area where the first data pattern 510 overlaps the gate electrode 230 of the first transistor T1), a first contact hole CNT1 penetrating the third insulating layer 830 and the second insulating layer 820 to expose the gate electrode 230 of the first transistor T1 may be formed. The first data pattern 510 may be electrically connected to the gate electrode 230 of the first transistor T1 through the first contact hole CNT1.

The first contact hole CNT1 may be located in the opening of the electrode line 340 of the storage capacitor CST. In the first contact hole CNT1, the first data pattern 510 and the electrode line 340 of the storage capacitor CST adjacent to the first data pattern 510 may be insulated from each other by the third insulating layer 830.

The first data pattern 510 may extend upward from the area overlapping the gate electrode 230 of the first transistor T1 and may overlap the second scan line 320 while being insulated from the second scan line 320. The first data pattern 510 may extend further upward and overlap a lower portion of the third vertical part 130 (or the second lower semiconductor pattern) of the lower semiconductor layer 100.

In an area where the first data pattern 510 overlaps the third vertical part 130 of the lower semiconductor layer 100, a second contact hole CNT2 penetrating the first through third insulating layer 810 through 830 to expose the second electrode of the eighth transistor T8 may be formed. The first data pattern 510 may be electrically connected to the second electrode of the eighth transistor T8 through the second contact hole CNT2.

In addition, the first data pattern 510 may further extend upward and overlap the second upper semiconductor pattern 420. A portion of the first data pattern 510 which overlaps the second upper semiconductor pattern 420 may form the first electrode of the fourth transistor T4.

The second data pattern 520 may overlap the first vertical part 110 (or the horizontal part 140) of the lower semiconductor layer 100. In an area where the second data pattern 520 overlaps the first vertical part 110 of the lower semiconductor layer 100, a third contact hole CNT3 penetrating the first through third insulating layers 810 through 830 to expose the first vertical part 110 of the lower semiconductor layer 100 may be formed. The second data pattern 520 may be electrically connected to the second electrode of the first transistor T1 and/or the second electrode of the sixth transistor T6 through the third contact hole CNT3.

The second data pattern 520 may extend upward and overlap the first upper semiconductor pattern 410. A portion of the second data pattern 520 which overlaps the first upper semiconductor pattern 410 may form the first electrode of the third transistor T3.

The third data pattern 530 may overlap the first upper semiconductor pattern 410. A portion of the third data pattern 530 which overlaps the first upper semiconductor pattern 410 may form the second electrode of the third transistor T3.

In addition, the third data pattern 530 may overlap the third vertical part 130 of the lower semiconductor layer 100. In an area where the third data pattern 530 overlaps the first upper semiconductor pattern 410, a fourth contact hole CNT4 penetrating the first through third insulating layers 810 through 830 to expose the third vertical part 130 of the lower semiconductor layer 100 may be formed. The third data pattern 530 may be electrically connected to the first electrode of the eighth transistor T8 through the fourth contact hole CNT4.

The third conductive layer 500 may include one or more metals selected from molybdenum (Mo), aluminum (Al), platinum (Pt), palladium (Pd), silver (Ag), magnesium (Mg), gold (Au), nickel (Ni), neodymium (Nd), iridium (Ir), chromium (Cr), calcium (Ca), titanium (Ti), tantalum (Ta), tungsten (W) and copper (Cu). The third conductive layer 500 may be a single layer or a multilayer. For example, the third conductive layer 500 may have a laminated structure of Ti/Al/Ti, Mo/Al/Mo, Mo/AlGe/Mo, or Ti/Cu.

The fourth insulating layer 840 may be disposed on the third conductive layer 500 and may be disposed over the entire surface of the substrate 910. The fourth insulating layer 840 may be an interlayer insulating film that insulates the third conductive layer 500 from the fourth conductive layer 600. The fourth insulating layer 840 may include the same material as the second insulating layer 820 described above or may include one or more materials selected from the materials exemplified as the material of the second insulating layer 820. The fourth insulating layer 840 may be a single layer or a multilayer consisting of laminated layers of different materials.

The fourth conductive layer 600 is disposed on the fourth insulating layer 840. The fourth conductive layer 600 may include a first power supply voltage wiring 610 for supplying the first power supply voltage ELVDD, a bridge wiring 620 of the initialization voltage line 310, and fifth and sixth data patterns 630 and 640.

As illustrated in FIG. 6, the first power supply voltage wiring 610 may extend in the row direction across the central part of the pixel PX. The first power supply voltage wiring 610 may extend along the row direction to the neighboring pixels beyond the boundaries of the pixel PX. The first power supply voltage wiring 610 may extend upward from one side of the pixel PX and extend downward from the other side of the pixel PX. For example, the first power supply voltage wiring 610 may extend upward from a center-left part of the pixel PX and extend downward from a center-right part of the pixel PX. The first power supply voltage wiring 610 may also extend along the column direction to neighboring pixels beyond boundaries of the pixel PX.

The first power supply voltage wiring 610 may cover most of the pixel PX except for the bridge wiring 620 and the fifth and sixth data patterns 630 and 640. That is, the first power supply voltage wiring 610 may be formed as wide as possible. In this case, a relatively uniform current may be supplied to pixels through the first power supply voltage wiring 610, and a long area of the display device 1 may have a long range uniformity (LRU) of 90% or more. In addition, the first power supply voltage wiring 610, that is, a direct current (DC) voltage wiring may be formed between the gate electrode 230 of the first transistor T1 and a data line, which will be described later, to reduce crosstalk caused by the data line.

The bridge wiring 620 may overlap the initialization voltage line 310 and extend downward.

The fifth data pattern 630 may overlap the upper portion 121 of the second vertical part 120 of the lower semiconductor layer 100. In an area where the fifth data pattern 630 overlaps the upper portion 121 of the second vertical part 120 of the lower semiconductor layer 100, a sixth contact hole CNT6 penetrating the first through fourth insulating layers 810 through 840 to expose the lower semiconductor layer 100 may be formed. The fifth data pattern 630 may be electrically connected to the first electrode of the second transistor T2 through the sixth contact hole CNT6.

The sixth data pattern 640 may overlap the first vertical part 110 of the lower semiconductor layer 100. In an area where the sixth data pattern 640 overlaps the first vertical part 110 of the lower semiconductor layer 100, a fifth contact hole CNT5 may be formed. The sixth data pattern 640 may be electrically connected to the first electrode of the sixth transistor T6 through the fifth contact hole CNT5.

The fourth conductive layer 600 may include one or more metals selected from molybdenum (Mo), aluminum (Al), platinum (Pt), palladium (Pd), silver (Ag), magnesium (Mg), gold (Au), nickel (Ni), neodymium (Nd), iridium (Ir), chromium (Cr), calcium (Ca), titanium (Ti), tantalum (Ta), tungsten (W) and copper (Cu). The fourth conductive layer 600 may be a single layer or a multilayer. For example, the fourth conductive layer 600 may have a laminated structure of Ti/Al/Ti, Mo/Al/Mo, Mo/AlGe/Mo, or Ti/Cu.

The fifth insulating layer 850 may be disposed on the fourth conductive layer 600 and may be generally disposed over the entire surface of the substrate 910. The fifth insulating layer 850 may insulate the fourth conductive layer 600 from the fifth conductive layer 700. The fifth insulating layer 850 may include the same material as the second insulating layer 820 described above or may include one or more materials selected from the materials exemplified as the material of the second insulating layer 820. The fifth insulating layer 850 may be a single layer or a multilayer consisting of laminated layers of different materials.

The fifth conductive layer 700 is disposed on the fifth insulating layer 850. The fifth conductive layer 700 may include a data line 710 and a via electrode 720.

The data line 710 may be disposed on the right side of the pixel PX and extend along the column direction. In an area where the data line 710 overlaps the fifth data pattern 630, a twenty-first contact hole CNT21 penetrating the fifth insulating layer 850 to expose the fifth data pattern 630 may be formed. In this case, the data line 710 may be electrically connected to the fifth data pattern 630 through the twenty-first contact hole CNT21 and may also be electrically connected to the first electrode of the second transistor T2 through the fifth data pattern 630 and an eleventh contact hole CNT11.

The via electrode 720 may overlap the sixth data pattern 640. In an area where the via electrode 720 overlaps the sixth data pattern 640, a twenty-second contact hole CNT22 penetrating the fifth insulating layer 850 to expose the sixth data pattern 640 may be formed. In this case, the via electrode 720 may be electrically connected to the sixth data pattern 640 through the twenty-second contact hole CNT22 and may also be electrically connected to the second electrode of the sixth transistor T6 through the sixth data pattern 640 and a twelfth contact hole CNT12.

The fifth conductive layer 700 may include one or more metals selected from molybdenum (Mo), aluminum (Al), platinum (Pt), palladium (Pd), silver (Ag), magnesium (Mg), gold (Au), nickel (Ni), neodymium (Nd), iridium (Ir), chromium (Cr), calcium (Ca), titanium (Ti), tantalum (Ta), tungsten (W) and copper (Cu). The fifth conductive layer 700 may be a single layer or a multilayer. For example, the fifth conductive layer 700 may have a laminated structure of Ti/Al/Ti, Mo/Al/Mo, Mo/AlGe/Mo, or Ti/Cu.

A sixth insulating layer 860 may be disposed on the fifth conductive layer 700 and may be generally disposed over the entire surface of the substrate 910. The sixth insulating layer 860 may insulate the fifth conductive layer 700 from the light emitting element EL. The sixth insulating layer 860 may include the same material as the second insulating layer 820 described above or may include one or more materials selected from the materials exemplified as the material of the second insulating layer 820. The sixth insulating layer 860 may be a single layer or a multilayer consisting of laminated layers of different materials.

An anode ANODE of the light emitting element EL may be disposed on the sixth insulating layer 860. The anode ANODE may overlap the via electrode 720. In an area where the anode ANODE overlaps the via electrode 720, a contact hole (not illustrated) penetrating the sixth insulating layer 860 to expose the via electrode 720 may be formed. The anode ANODE may be electrically connected to the via electrode 720 through the contact hole (not illustrated).

In addition, the anode ANODE may overlap the third and fourth transistors T3 and T4. In this case, the anode ANODE may block external light incident from above the third and fourth transistors T3 and T4 (that is, bottom-gate transistors).

A pixel defining layer PDL is disposed along edges of the anode ANODE. Although not illustrated, a cathode CATHOD of the light emitting element EL may be disposed on the anode ANODE.

As described above with reference to FIGS. 4 through 6, each of the first, second and fifth through eighth transistors T1, T2 and T5 through T8 may be a top-gate PMOS transistor, and each of the third and the fourth transistors T3 and T4 may be a bottom-gate NMOS transistor. In plan view, the initialization voltage line 310, the third scan line 330, the first scan line 210, the second scan line 320, and the emission control line 220 may be sequentially arranged from the top to the bottom of the pixel PX. The third transistor T3 may overlap the second scan line 320, and the eighth transistor T8 located above the third transistor T3 in the pixel PX may overlap the first scan line 210. In addition, the third transistor T3, the eighth transistor T8 and the fourth transistor T4 may be sequentially arranged from the left side to the right side of the pixel PX.

In FIG. 7, each of the third and fourth transistors T3 and T4 is illustrated as a bottom-gate NMOS transistor. However, the present disclosure is not limited to this case. For example, each of the third and fourth transistors T3 and T4 may also be a top-gate type NMOS transistor.

Figure 8:
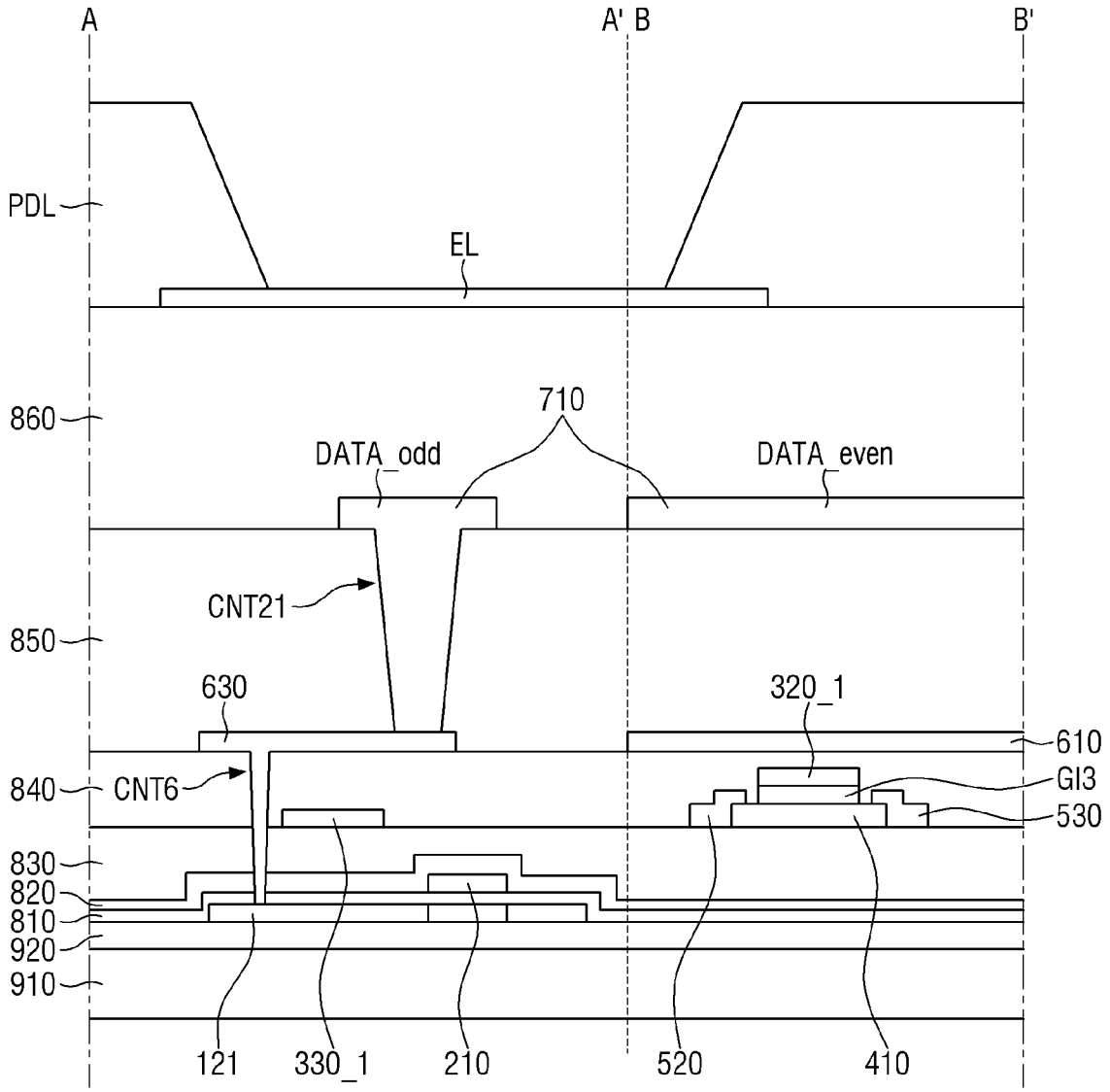
FIG. 8 is a cross-sectional view taken along lines A-A' and B-B' of FIG. 4 of another pixel according to an exemplary embodiment.

FIG. 8 is a cross-sectional view of a pixel according to an exemplary embodiment.

Referring to FIGS. 2, 4, 7 and 8, a second scan line 320_1 (or a third conductive layer) may be disposed on a first upper semiconductor pattern 410 (or an upper semiconductor layer 400) instead of a second insulating layer 820.

A gate insulating layer GI3 may be disposed on the first upper semiconductor pattern 410 (or the upper semiconductor layer 400). The gate insulating layer GI3 may be disposed on the first upper semiconductor pattern 410 only in an area overlapping the second scan line 320_1.

The second scan line 320_1 may be disposed on the gate insulating layer GI3.

Although not illustrated, a fourth transistor T4 may have substantially the same laminated structure as a third transistor T3.

Therefore, the third transistor T3 (and the fourth transistor T4) may also be implemented as a top-gate NMOS transistor.

Figure 9:
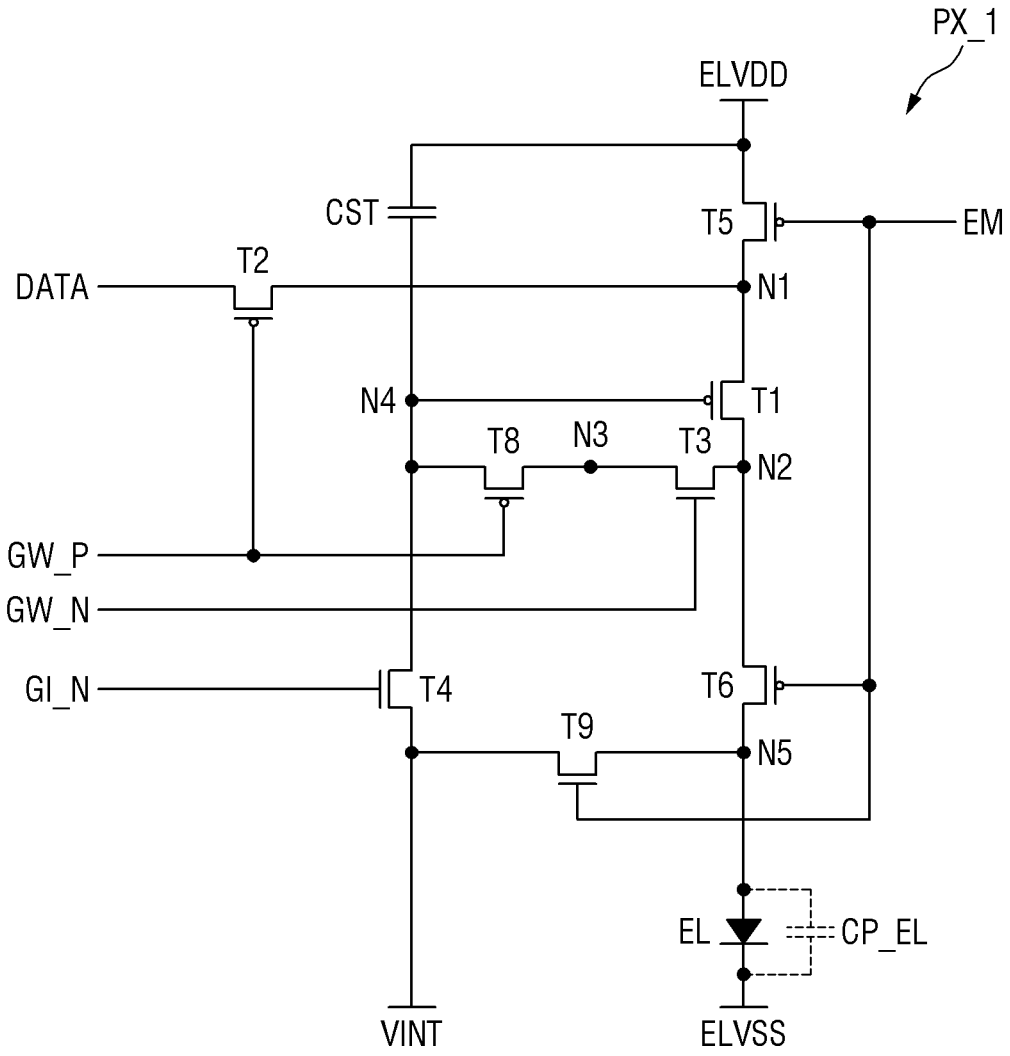
FIG. 9 is a circuit diagram of a pixel according to an exemplary embodiment.

FIG. 9 is a circuit diagram of a pixel PX_1 according to an exemplary embodiment.

Referring to FIGS. 2 and 9, the pixel PX_1 is different from the pixel PX of FIG. 2 in that it includes a ninth transistor T9 instead of a seventh transistor T7.

A light emitting element EL, a storage capacitor CST and first through sixth and eighth transistors T1 through T6 and T8 are substantially the same as the light emitting element EL, the storage capacitor CST and the first through sixth and eighth transistors T1 through T6 and T8, and thus a redundant description will not be repeated.

The ninth transistor T9 may include a first electrode connected to a fifth node N5, a second electrode connected to an initialization voltage line (or an initialization voltage VINT), and a gate electrode connected to an emission control signal line or receiving an emission control signal EM.

The ninth transistor T9 may be an NMOS transistor. The ninth transistor T9 may receive the emission control signal EM in the same manner as the fifth transistor T5 and the sixth transistor T6, but may be turned on in a period different from a turn-on period (or turn-on timing) of the fifth transistor T5 and the sixth transistor T6. For example, when the emission control signal EM is a high-level voltage (or a logic high level), the ninth transistor T9 may be turned on, and the fifth transistor T5 and the sixth transistor T6 may be turned off. For another example, when the emission control signal EM is a low-level voltage (or a logic low level), the ninth transistor T9 may be turned off, and the fifth transistor T5 and the sixth transistor T6 may be turned on. Therefore, an initialization operation by the ninth transistor T9 may not be performed at an emission time when the fifth transistor T5 and the sixth transistor T6 are turned on and may be performed at a non-emission time when the fifth transistor T5 and the sixth transistor T6 are turned off.

A display device according to an exemplary embodiment can effectively prevent a gate voltage of a first transistor from being dropped by a kickback without significant modifications to the layout.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a light emitting element;

a first transistor configured to transmit a driving current to the light emitting element;

a second transistor connected to a first electrode of the first transistor and configured to transmit a data signal;

a third transistor comprising a first electrode connected to a second electrode of the first transistor;

an auxiliary transistor connected between a second electrode of the third transistor and a gate electrode of the first transistor and configured to transmit the data signal to the gate electrode of the first transistor; and a first scan line, wherein each of the first transistor, the second transistor, and the auxiliary transistor is a first-type transistor, wherein the third transistor is a second-type transistor different from the first-type transistor, and wherein a gate electrode of the second transistor and a gate electrode of the auxiliary transistor are connected to the first scan line to receive a same scan signal.

2. The display device of claim 1, wherein the first-type transistor is a P-channel metal-oxide-semiconductor field-effect transistor (PMOS transistor), and wherein the second-type transistor is an N-channel metal-oxide-semiconductor field-effect transistor (NMOS transistor).

3. The display device of claim 1, wherein the first-type transistor is a top-gate transistor in which a gate electrode is disposed above a semiconductor layer, and wherein the second-type transistor is a bottom-gate transistor in which a gate electrode is disposed below a semiconductor layer.

4. The display device of claim 1, wherein the first-type transistor comprises an oxide semiconductor, and wherein the second-type transistor comprises polycrystalline silicon.

5. The display device of claim 1, further comprising:

a fourth transistor connected between the gate electrode of the first transistor and an initialization voltage line, wherein the fourth transistor is the second-type transistor.

6. The display device of claim 5, further comprising:

a fifth transistor connected between the first electrode of the first transistor and a first power supply voltage wiring;

a sixth transistor connected between the second electrode of the first transistor and a first electrode of the light emitting element;

a seventh transistor connected between the first electrode of the light emitting element and the initialization voltage line; and a storage capacitor formed between the first electrode of the first transistor and the first power supply voltage wiring, wherein each of the fifth, sixth and seventh transistors is the first-type transistor.

7. The display device of claim 1, further comprising:

a second scan line, wherein a gate electrode of the third transistor is connected to the second scan line.

8. The display device of claim 7, wherein the second transistor and the auxiliary transistor are configured to be turned on in a first period in response to a first scan signal provided through the first scan line, and wherein the third transistor is configured to be turned on in the first period in response to a second scan signal provided through the second scan line.

9. The display device of claim 7, wherein the second transistor and the auxiliary transistor are configured to be turned on in a first period in response to a first scan signal provided through the first scan line, wherein the third transistor is configured to be turned on in a second period in response to a second scan signal provided through the second scan line, and wherein the second period is greater than the first period and comprises the first period.

10. The display device of claim 9, wherein the second scan signal has a turn-on voltage level in the second period, and wherein the second period of the second scan signal partially overlaps the second period of the second scan signal of a previous time point.

11. The display device of claim 7, wherein in plan view, the second scan line is disposed in a first direction based on the first transistor and extends in a second direction perpendicular to the first direction, wherein the first scan line is disposed in the first direction based on the second scan line and is parallel to the second scan line, wherein the third transistor partially overlaps the second scan line, and wherein the auxiliary transistor partially overlaps the first scan line.

12. The display device of claim 11, wherein the third transistor has a channel extending in the first direction, wherein the auxiliary transistor has a channel extending in the first direction, and wherein the channel of the auxiliary transistor lies on a line different from a line on which the channel of the third transistor extends.

13. The display device of claim 12, further comprising:

a data pattern which extends in the second direction, wherein an end of the data pattern forms an electrode of the third transistor, and wherein the data pattern is connected to the electrode of the third transistor through a first contact hole.

14. The display device of claim 7, wherein a first insulating layer is disposed on the third transistor, the first scan line and the gate electrode of the third transistor are disposed on the first insulating layer, and the second scan line is disposed on a layer different from a layer on which the first scan line is disposed.

15. The display device of claim 1, further comprising:

a fourth transistor connected between the gate electrode of the first transistor and an initialization voltage line;

a fifth transistor connected between the first electrode of the first transistor and a first power supply voltage wiring;

a sixth transistor connected between the second electrode of the first transistor and the first electrode of the light emitting element;

a seventh transistor connected between an anode electrode of the light emitting element and the initialization voltage line; and a storage capacitor formed between the first electrode of the first transistor and the first power supply voltage wiring, wherein each of the fourth and seventh transistors is the second-type transistor, and wherein each of the fifth and sixth transistors is the first-type transistor.

16. The display device of claim 15, further comprising:

an emission control signal line connected to a gate electrode of each of the fifth through seventh transistors, wherein the fifth and sixth transistors are configured to be turned on in a third period in response to an emission control signal provided through an emission control signal line, and wherein the seventh transistor is configured to be turned off in the third period in response to the emission control signal.

17. The display device of claim 1, wherein the light emitting element is a quantum-dot light emitting element.

18. A display device comprising:

a light emitting element;

a first transistor configured to transmit a driving current to the light emitting element;

a second transistor connected to a first electrode of the first transistor and configured to transmit a data signal;

a third transistor connected between a second electrode of the first transistor and a gate electrode of the first transistor and configured to transmit the data signal to the gate electrode of the first transistor; and a first scan line, wherein the third transistor comprises first and second sub-transistors having different channel types and connected in series to each other, and wherein a gate electrode of the second transistor and a gate electrode of the first sub-transistor are connected to the first scan line to receive a same scan signal.

19. The display device of claim 18, wherein the first sub-transistor is a PMOS transistor, and wherein the second sub-transistor is an NMOS transistor.

20. The display device of claim 18, wherein the first sub-transistor is a top-gate transistor in which a gate electrode is disposed above a semiconductor layer, and wherein the second sub-transistor is a bottom-gate transistor in which a gate electrode is disposed below a semiconductor layer.

21. The display device of claim 18, wherein the first sub-transistor comprises an oxide semiconductor, and wherein the second sub-transistor comprises polycrystalline silicon.

22. The display device of claim 18, wherein the light emitting element is a quantum-dot light emitting element.

* * * * *